US005802427A

United States Patent [19]

Sawada et al.

[11] Patent Number: 5,802,427

[45] Date of Patent: Sep. 1, 1998

[54] IMAGE FORMING APPARATUS HAVING MEANS TO DISABLE A DRIVE FORCE WHEN AN APPARATUS COVER IS OPENED

[75] Inventors: Kenji Sawada, Toyokawa; Masahiro Sato, Toyohashi; Hitoshi Sekino; Masashi Sakamoto, both of Toyokawa, all of Japan

[73] Assignee: Minolta, Co., Ltd., Osaka, Japan

[21] Appl. No.: 715,828

[22] Filed: Sep. 19, 1996

Related U.S. Application Data

[62] Division of Ser. No. 554,547, Nov. 7, 1995, Pat. No. 5,587,769.

[30] Foreign Application Priority Data

Nov. 11, 1994 [JP] Japan ..... 6-277533

[51] Int. Cl.[6] ..... G03G 15/00; G03G 15/20

[52] U.S. Cl. ..... 399/122; 399/33; 399/124

[58] Field of Search ..... 399/88, 89, 122, 399/124, 125, 21, 9, 33, 67

[56] References Cited

U.S. PATENT DOCUMENTS

| | | | |
|---|---|---|---|
| 4,531,823 | 7/1985 | Deguchi et al. | 399/124 |
| 4,791,453 | 12/1988 | Koseki et al. | 399/33 X |
| 5,041,872 | 8/1991 | Nukaya et al. | 399/107 |
| 5,107,304 | 4/1992 | Haneda et al. | 399/112 |
| 5,113,220 | 5/1992 | Kwak | 399/114 |
| 5,146,270 | 9/1992 | Matsuo et al. | 399/112 |
| 5,255,061 | 10/1993 | Matsuura et al. | 399/124 |
| 5,291,256 | 3/1994 | Kitajima et al. | 399/122 |
| 5,300,998 | 4/1994 | Ogisawa et al. | 399/124 |
| 5,438,391 | 8/1995 | Maekawa et al. | 399/125 |
| 5,440,373 | 8/1995 | Deki et al. | 399/113 |
| 5,442,428 | 8/1995 | Takahashi et al. | 399/302 |

FOREIGN PATENT DOCUMENTS

| | | |
|---|---|---|
| 60-149063 | 8/1985 | Japan . |
| 3-24576 | 2/1991 | Japan . |
| 4-156560 | 5/1992 | Japan . |
| 5-80597 | 4/1993 | Japan . |

*Primary Examiner*—Arthur T. Grimley
*Assistant Examiner*—Sophia S. Chen
*Attorney, Agent, or Firm*—Sidley & Austin

[57] ABSTRACT

An image forming apparatus has an apparatus housing having a releasible and movable side frame, and a stationary side frame, a photosensitive unit having a photosensitive member and which is detachably mounted on the movable side frame, and an intermediate transfer unit having an intermediate transfer member for temporarily receiving a transferred toner image formed on the surface of the photosensitive member in a primary transfer, and transferring the temporarily transfer toner image to a recording sheet in a secondary transfer, the intermediate transfer unit being detachably mounted on the movable side frame.

21 Claims, 26 Drawing Sheets

146

40
145
145a
145b
140
145c 147
148
10
149
148
148a

IMAGE FORMING APPARATUS HAVING MEANS TO DISABLE A DRIVE FORCE WHEN AN APPARATUS COVER IS OPENED

This application is a division, of application Ser. No. 08/554,547, filed Nov. 7, 1995, which became U.S. Pat. No. 5,587,769 on Dec. 24, 1996.

BACKGROUND OF THE INVENTION

1. Field of the Invention

The present invention relates to an image forming apparatus, and specifically relates to an apparatus for forming a full color image on a recording sheet by electrophotographic method.

2. Description of the Related Art

Generally, in full color copiers and printers using electrophotographic methods, four developing devices are provided which respectively accommodate cyan (C), magenta (M), yellow (Y), and black (Bk) toner corresponding to the three primary color red (R), green (G), and blue (B), as well as black (Bk), wherein a toner image of each color is formed on the surface of a photosensitive member and transferred onto an intermediate transfer member in sequential primary transfers to form a four-color overlay, and the full color image comprising said four-color overlay is transferred onto a recording sheet at one time via a secondary transfer. Although a small type photosensitive member having a diameter of about 30 mm is usable, the intermediate transfer member must be of a size at least equal to the size of the largest recording sheet usable in a printer or the like. Accordingly, conventional intermediate transfer members are fixedly mounted in the apparatus, and cannot be replaced by a user. Certain disadvantages arise when the intermediate transfer member is fixedly mounted in the apparatus, including inconvenience during maintenance, and lack of assured space when removing paper jams and the like.

Consideration has been given to designs which allow the intermediate transfer member and photosensitive member to be removed from the apparatus body, but such removable construction requires elimination of the problems described below. First, toner leakage must be prevented from the residual toner cleaning means provided for the intermediate transfer member. Typically, such cleaning means is constructed so as to make pressing contact with the intermediate transfer member only during secondary transfers, and is separated from the intermediate transfer member at all other times. Thus, when the intermediate transfer member is removed from the apparatus body while the cleaning means is in the separated state with respect to said intermediate transfer member, toner may leak from the gap between the intermediate transfer member and the cleaning means. Then, the problem of protecting the exterior surfaces of the photosensitive member and intermediate transfer member must be addressed. When a hand inadvertently touches the photosensitive member or intermediate transfer member, oils adhere to the members and cause deterioration of image quality or said members are damaged by contact with foreign matter.

SUMMARY OF THE INVENTION

An object of the present invention is to provide an image forming apparatus which allows simple replacement of an intermediate transfer member by a user, and easy maintenance and handling of paper jams by allowing wide access to the interior of the apparatus.

Another object of the present invention is to provide an image forming apparatus comprising an apparatus housing having a releasible and movable side frame, a stationary side frame, a photosensitive unit having a photosensitive member and which is detachably mounted on said movable side frame, and an intermediate transfer unit having an intermediate transfer member for temporarily receiving a transferred toner image formed on the surface of said photosensitive member in a primary transfer, and transferring said temporarily transfer toner image to a recording sheet in a secondary transfer, said intermediate transfer unit being detachably mounted on said movable side frame.

Still another object of the present invention is to provide an image forming apparatus which eliminates the concern for toner leakage from the cleaning means when the apparatus body is opened and the intermediate transfer member is removed.

These objects of the present invention are achieved by providing an image forming apparatus having the aforesaid construction wherein the cleaning means for eliminating residual toner from the surface of the intermediate transfer member via pressure contact with said intermediate transfer member is provided in the intermediate transfer unit so as to be in a state of non-contact with the intermediate transfer member when the movable side frame is locked, and in a state of contact with the intermediate transfer member when said movable side frame is released.

An even further object of the present invention is to provide an image forming apparatus capable of effectively protecting the photosensitive member and the intermediate transfer member when the apparatus body is opened and the photosensitive member and intermediate transfer member are removed.

This object of the present invention is achieved by providing an image forming apparatus of the aforesaid construction wherein the photosensitive unit is provided with a photosensitive member shutter member which covers the exposure portion, developing portion, and primary transfer portion of the photosensitive member when the photosensitive unit is removed from the movable side frame, and which releases said exposure portion and developing portion when the photosensitive unit is installed on the movable side frame and the primary transfer portion is released when said movable side frame is locked, and wherein the intermediate transfer unit is provided with a first shutter member for covering said primary transfer portion in conjunction with the installation or detachment of the photosensitive unit on the movable side frame while said movable side frame is in the released state, and wherein said intermediate transfer unit is provided with a second shutter which covers and releases a secondary transfer portion in conjunction with the opening and closing of said movable side frame.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the image forming apparatus of the present invention are described hereinafter with reference to the accompanying drawings. The embodiments described below are applications of the present invention with respect to a full color laser printer.

General printer construction

Figure 1:
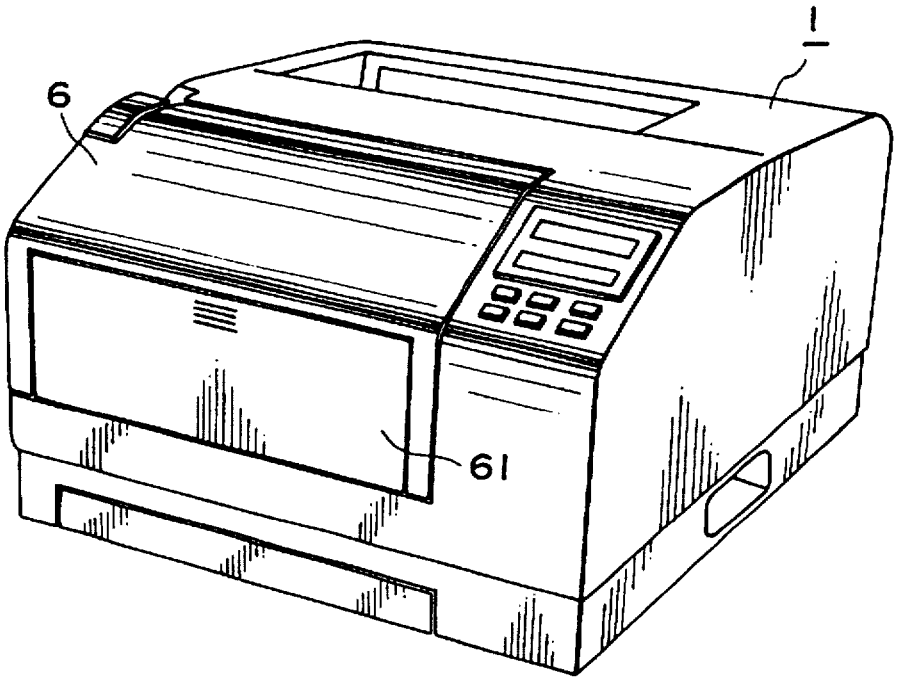
FIG. 1 is a perspective view showing the exterior of a full color laser printer of an embodiment of the present invention.
Figure 2:
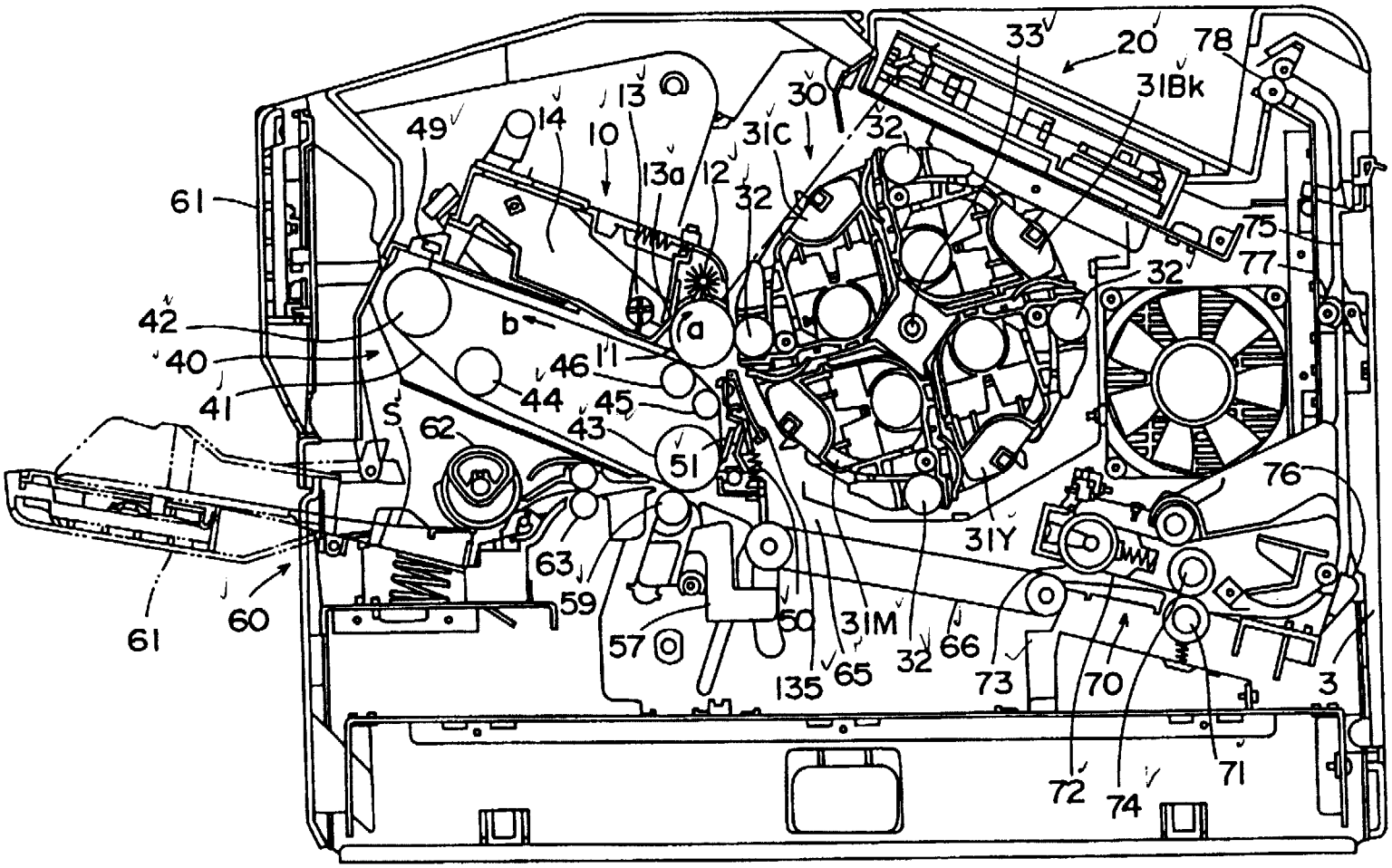
FIG. 2 shows the interior construction of the printer when the movable side frame is locked.

FIG. 1 shows the exterior of a full color laser printer viewed from the front, and FIG. 2 shows the interior construction of the same printer. In FIG. 2, the printer briefly comprises a photosensitive unit 10 having a photosensitive drum 11 which is rotatably driven in the arrow a direction, laser scanning unit 20, full color developing unit 30, intermediate transfer unit 40 having an endless type intermediate transfer belt 41 rotatably driven in the arrow b direction, and paper supply section 60. Photosensitive unit 10 is internally provided with an arrangement of charging brush 12 and cleaner 13, and a waste toner compartment 14 located behind said cleaner 13. Charging brush 12 uniformly charges the surface of photosensitive drum 11 to a predetermined potential. Cleaner 13 removes the residual toner remaining on the surface of photosensitive drum 11 by means of blade 13*a*.

Laser scanning unit 20 is a well-known type unit with built in laser diode, polygonal mirror, and fθ optical element, and the control section of the unit receives from a host computer cyan (C), magenta (M), yellow (Y), and black (Bk) print data. Laser scanning unit 20 sequentially outputs print data for each color as laser beams which scan the surface of photosensitive drum 11. Thus, electrostatic latent images are sequentially formed on the surface of photosensitive drum 11.

Full color developing unit 30 integrates four different color developing devices 31C, 31M, 31Y, and 3lBk which respectively accommodate developer containing C, M, Y, and Bk color toner, and are rotatable in a clockwise direction about the pivot point of shaft 33. Each developing device is switchable via rotation so as to bring to a developing position the developing sleeve 32 of a developing device corresponding to the color of each latent image formed on the surface of photosensitive drum 11. In the present embodiment, a rotary type full color developing unit 30 is used to render the entire printer more compact.

In intermediate transfer unit 40, intermediate transfer belt 41 is an endless type belt looped around support rollers 42 and 43 and tension rollers 44 and 45, and is rotatably driven in the arrow b direction synchronously with photosensitive drum 11. A notch (not illustrated) is provided on the side of intermediate transfer belt 41; this notch is detected by microswitch 49 to control the image formation processes of exposure, developing, and transfer. Intermediate transfer belt 41 makes pressure contact with a rotatable primary transfer roller 46 so as to come into contact with photosensitive drum 11; this region of contact between photosensitive drum 11 and intermediate transfer belt 41 is the primary transfer section. Intermediate transfer belt 41 confronts the horizontal feed path of the recording sheet (described later) at the section supported by support roller 43, and makes contact with rotatable secondary transfer roller 59. This region of contact between intermediate transfer belt 41 and secondary transfer roller 59 is the secondary transfer section.

A cleaner 50 is provided for intermediate transfer belt 41. Cleaner 50 is provided with a blade 51 for removing residual toner which remains on intermediate transfer belt 41. Blade 51 and the aforesaid secondary transfer roller 59 are retractable with respect to intermediate transfer belt 41 in a manner described later.

Full color printing operation

The full color printing operation of the present embodiment is briefly described hereinafter.

At the start of a printing operation, secondary transfer roller 59 and cleaning blade 51 are retracted from intermediate transfer belt 41. When the printing operation starts, photosensitive drum 11 is rotated in the arrow a direction, and intermediate transfer belt 41 is rotated in the arrow b direction at identical speeds, and the surface of photosensitive drum 11 is uniformly charged to a predetermined potential by charging brush 12.

Then, a cyan image is exposed on the surface of photosensitive drum 11 by laser scanning unit 20, so as to form an electrostatic latent image of the cyan image on photosensitive drum 11. This latent image is directly developed by developing device 31C, and the resulting toner image is transferred onto intermediate transfer belt 41 at the primary transfer section. Directly after the primary transfer is completed, developing device 31M is switched to the developing position, and magenta image exposure, development, and primary transfer are accomplished. Similarly, developing device 31Y is switched to the developing position, and yellow image exposure, development, and primary transfer are accomplished. Then, developing device 31Bk is switched to the developing position, and black image exposure, development, and primary transfer are accomplished, and the toner images of each primary transfer are overlaid on intermediate transfer belt 41.

When the last primary transfer is completed, developing unit 30 switches developing device 31C to the developing position in preparation for the next printing operation, and at the same time secondary transfer roller 59 and cleaning blade 51 are brought into pressure contact with intermediate transfer belt 41. At this time, the full color toner image formed on intermediate transfer belt 41 is transferred onto recording sheet S. When the secondary transfer is completed, secondary transfer roller 59 and cleaning blade 51 are retracted from intermediate transfer belt 41.

Opening and closing of the printer housing

Figure 3:
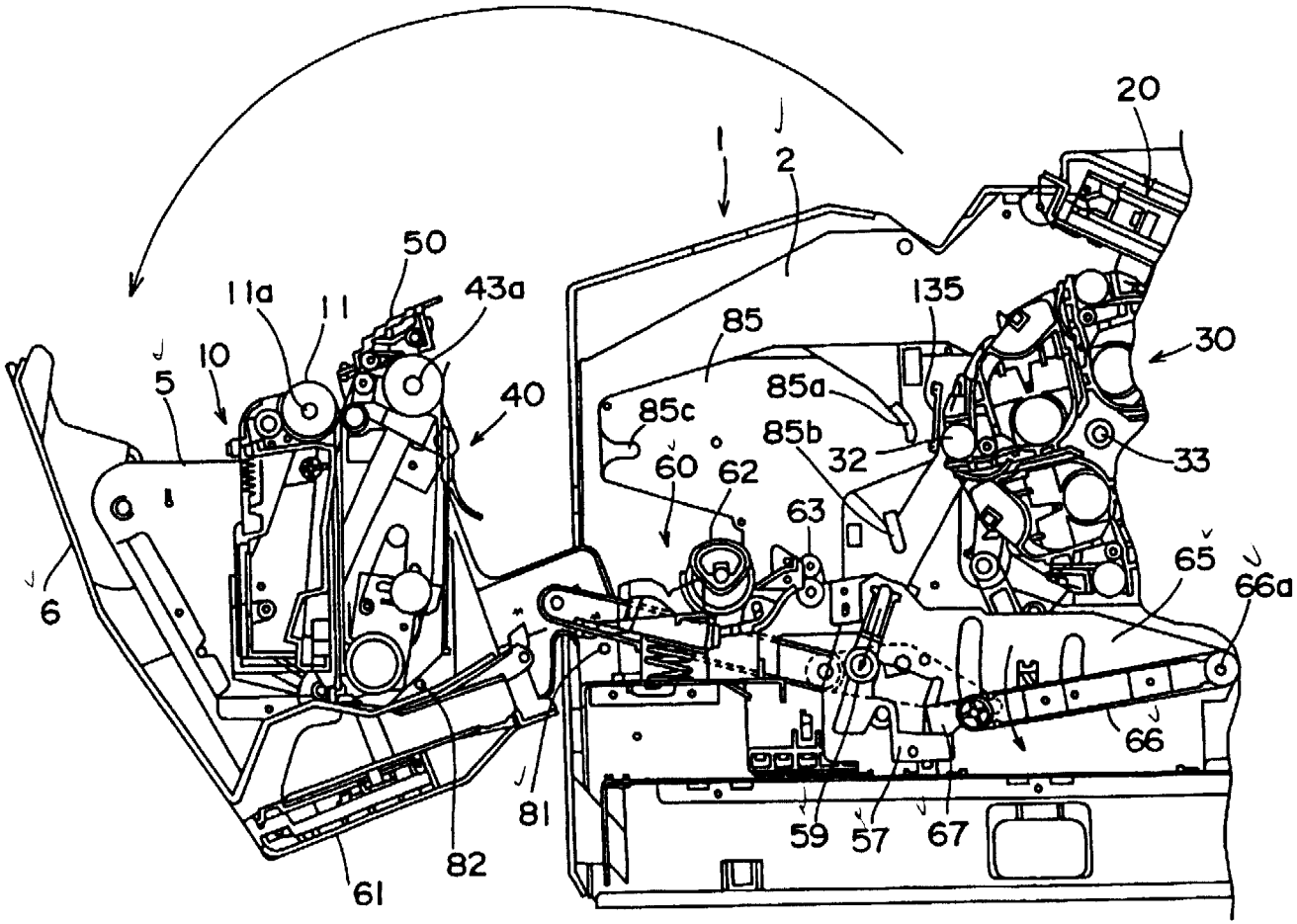
FIG. 3 shows the interior construction of the printer when the movable side frame is released.

Printer body 1 is divided into two halves comprising a stationary frame 2 and movable frame 5, as shown in FIG. 3. Movable frame 5 is rotatable on shaft 81, such that body 1 can be opened by rotating the front side of said body. Cover 6 is provided on movable frame 5, and cover 6 forms an exterior surface of printer body 1.

Stationary frame 2 accommodates laser scanning unit 20, developing unit 30, paper supply section 60, horizontal feed path 65, fixing device 70, vertical feed path 75 and the like. Movable frame 5 accommodates photosensitive unit 10 and intermediate transfer unit 40. No. 91 movable frame 5 also accommodates feeding tray 61 which, as shown in FIGS. 1 and 2, is able to open and shut with respect to the movable frame. FIG. 1 shows the feeding tray in the shut position and FIG. 2 shows the feeding tray in the open position. When movable frame 5 is opened, developing unit 30, paper supply section 60, and horizontal feed path 65 are completely open so as to be accessible from outside the apparatus. In this open state, photosensitive member unit 10 and intermediate transfer unit 40 can be detached from movable frame 5, and each developing device 31 can be removed from developing unit 30.

Paper supply section 60 and horizontal feed path 65 can be completely opened to easily remove paper jams, as well as facilitate maintenance such as easy inspection or replacement of secondary transfer roller 59. Air-suction belt 66 pivots downward on shaft **66*a* in conjunction with opening movable frame 5 as previously described, such that the edge of side panel 67 of air-suction belt 66 presses against holder 57 mounted on secondary transfer roller 59 to move said secondary transfer roller 59** downward. Thus, removing paper jams can be accomplished even more easily.

Unit positioning mechanisms

Figure 4:
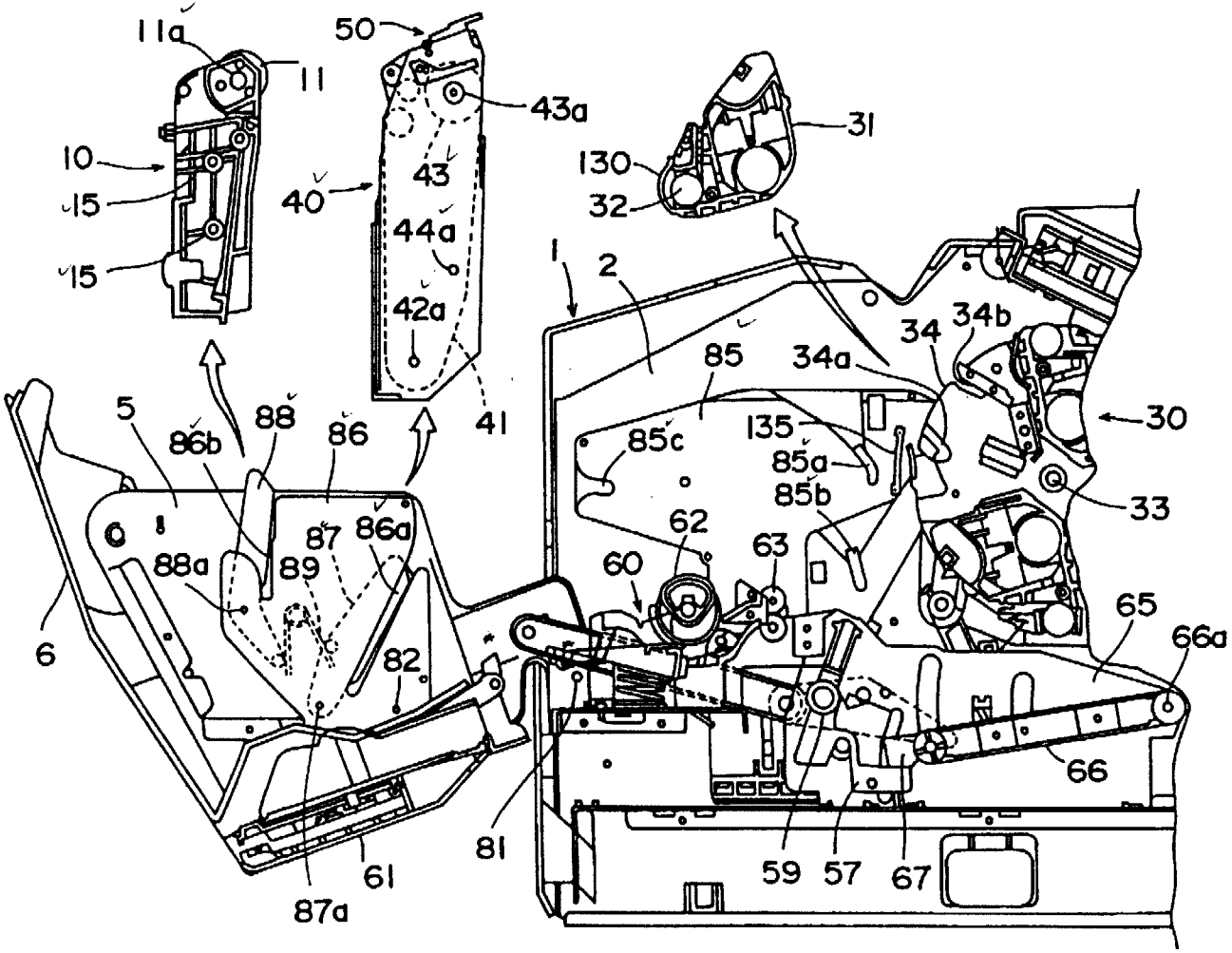
FIG. 4 is an illustration showing the photosensitive unit, intermediate transfer unit, and developing device removed from the printer.
Figure 5:
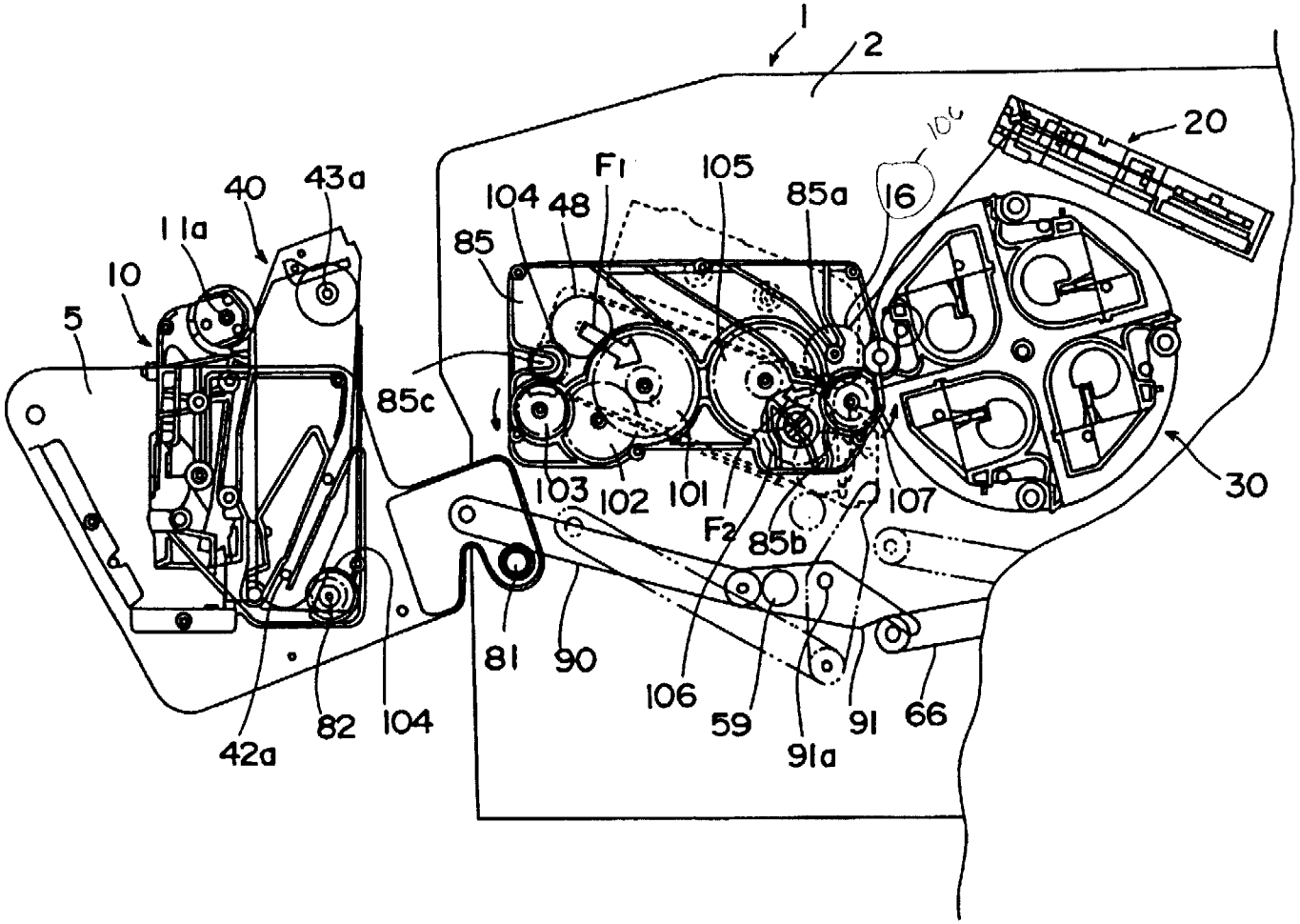
FIG. 5 is a side view showing the drive mechanism photosensitive unit and intermediate transfer unit when the movable side frame is released.

Photosensitive unit 10 and intermediate transfer unit 40 are detachable from movable frame 5 (the detachment mechanism is described later), and must be set at predetermined positions in printer body 1 when movable frame 5 is closed. Therefore, as shown in FIGS. 4 and 5, both ends of shaft **11*a* of photosensitive drum 11 extend outward in photosensitive unit 10, and both ends of shaft 43*a* of support roller 43*a* extend outward in intermediate transfer unit 40. Furthermore, both ends of shaft 82 extend outward in movable frame 5. On the other hand, a positioning plate 85 is fixedly mounted on bilateral interior sides of stationary frame 2, and channels 85*a*, 85*b*, and 85*c* are formed in said positioning plate 85. When movable frame 5 is closed, the bilateral ends of shafts 11*a*, 43*a*, and 82 respectively engage said channels 85*a*, 85*b*, and 85*c*, such that each shaft 11*a*, 43*a*, and 82 make contact with the interiors of channels 85*a*, 85*b*, and 85*c***, thereby positioning and locking each member at a predetermined position.

Unit detachment mechanisms

In FIG. 4, pins 15 extend from both sides of photosensitive unit 10, and shafts **42*a* and 44*a* extend from both sides of intermediate transfer unit 40. Positioning plates 86 are fixedly mounted at bilateral interior sides of movable frame 5, and channels 86*a* and 86*b* are formed in said positioning plates 86. The shafts 42*a* and 44*a* of intermediate transfer unit 40 engage channel 86*a*, and pins 15 of photosensitive unit 10 engage channel 86*b* when each said unit is installed on movable frame 5**.

On the other hand, levers 87 and 88 are provided on positioning panels 86 so as to be rotatable on pins **87*a* and 88*a*, each said lever 87 and 88 being forced in a clockwise direction by torsion spring 89. Installation on movable frame 5 starts with intermediate transfer unit 40. When unit 40 moves downward with shafts 42*a* and 44*a* moving along channel 86*a*, lever 87 is moved somewhat in a counterclockwise direction and presses against shafts 42*a* and 44*a* by the spring force of torsion spring 89. Unit 40 is positioned and locked on movable frame 5 by shaft 42*a* abutting the interior of channel 86*a*. When photosensitive unit 10 moves downward with pins 15 moving along channel 86*b*, lever 88 is moved somewhat in a counterclockwise direction and presses against pin 15 by the spring force of torsion spring 89. Unit 10 is positioned and locked on movable frame 5 by bottom pin 15 abutting the interior of channel 86*b***.

Horizontal feed path opening mechanism

Figure 6:
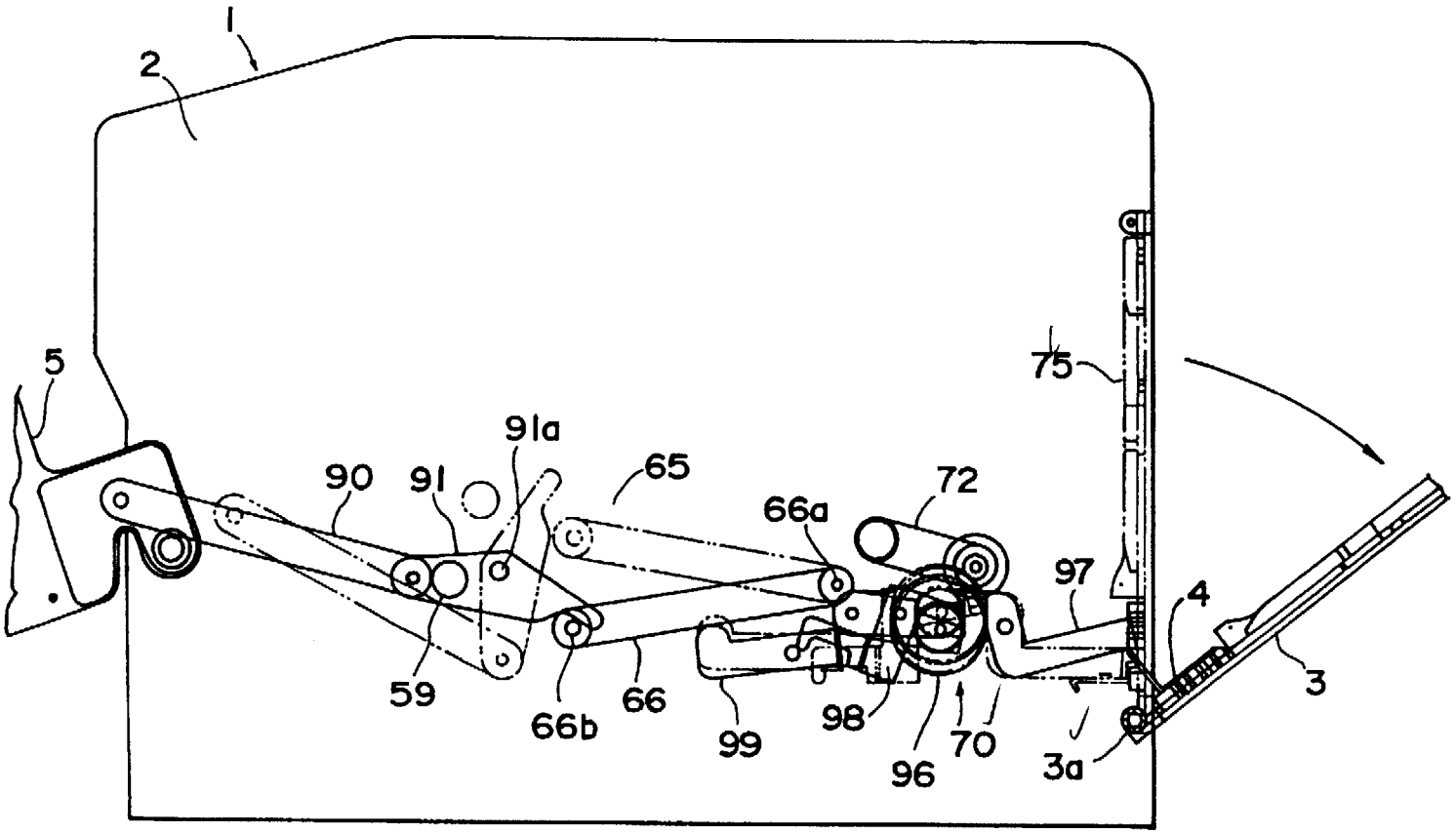
FIG. 6 is a side view showing the horizontal feed path of the unit drive mechanism and the opening/closing mechanism.

As shown in FIG. 6, a lever 90 and cam plate 91 are provided directly below horizontal feed path 65 to open said horizontal feed path 65 when movable frame 5 is opened. One end of lever 90 is connected to movable frame 5, and the other end is connected to cam plate 91. Cam plate 91 is rotatable on shaft **91*a*, and the leading end of said cam plate 91 can press against shaft 66*b* of air-suction belt 66 when rotated in a clockwise direction. Air-suction belt 66 is arranged so as to be rotatable on shaft 66*a*, and an upward force is exerted by a torsion spring (not illustrated) coiled around shaft 66*a*, such that normally belt 66 is moved upward as indicated by the dashed line in FIG. 6 to form horizontal feed path 65. Lever 90 and cam plate 91 are also set at the positions indicated by the dashed lines in FIG. 6 when movable frame 5** is closed.

When movable frame 5 is opened, lever 90 is pulled forward (leftward in FIG. 6) in conjunction with said operation, such that cam plate 91 is rotated in a clockwise direction. In conjunction with said rotation, the leading edge of cam plate 91 presses against shaft 66b, causing air-suction belt 66 to pivot downward on shaft 66a. Thus, secondary transfer roller 59 is also moved downward, and the horizontal feed path 65 is opened.

The downward movement of air-suction belt 66 is accomplished against the spring force of a torsion spring (not illustrated) coiled around shaft 66a, said torsion spring performing as a damper when movable frame 5 is opened.

Opening the back of body 1 and opening the fixing device

In the present embodiment, a back cover 3 is provided on the back of printer body 1. Back cover 3 moves backward on shaft 3a (refer to FIG. 6), so as to open vertical feed path 75 and allow easy removal of paper jams.

Figure 7:
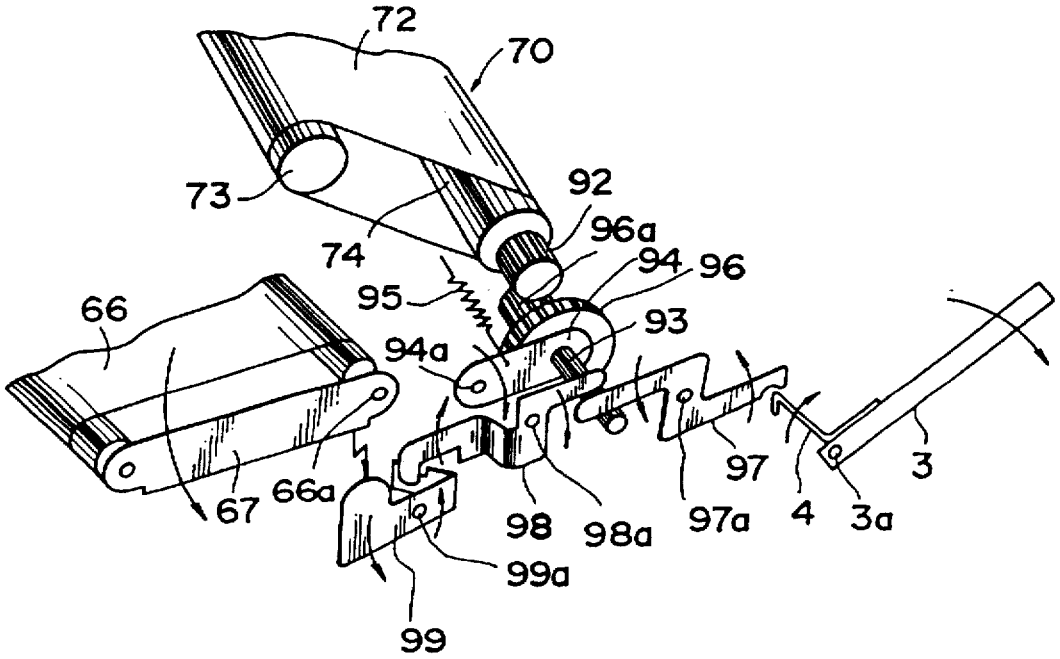
FIG. 7 is a perspective view showing the opening/closing mechanism of the fixing device.

Fixing device 70 can also be opened. As shown in FIG. 2, fixing device 70 comprises bottom roller 71 and fixing belt 72. Fixing belt 72 is an endless type belt held by heating roller 73 and drive shaft 74, and a gear 92 is mounted on drive shaft 74, as shown in FIG. 7. Bottom roller 71 is fixedly mounted on shaft 93, and shaft 93 is supported so as to be rotatable by lever 94. Lever 94 is rotatable on pin 94a, and an upward force is exerted thereon by coil spring 95. Bottom roller 71 is pressed against fixing belt 72 by the force exerted by coil spring 95, and a recording sheet S passes medially to said roller 71 and belt 72. Gear portion 96a of drive gear 96 mounted on shaft 93 engages belt drive gear 92, such that a drive force is transmitted from gear 96 to gear 92.

The ends of levers 97 and 98 engage shaft 93 from above. Lever 97 is freely rotatable on pin 97a, and the other end engages the leading end of lever 4 mounted on back cover 3. Lever 98 is freely rotatable on pin 98a, and the other end engages one end of lever 99, said lever 99 being freely rotatable on pin 99a below side panel 67 of air-suction belt 66.

In the aforesaid construction, when the back cover 3 is opened, lever 4 lifts the right end of lever 97, such that lever 97 is rotated in a counterclockwise direction. Thus, shaft 93 is driven downward together with lever 94, and bottom roller 71 is retracted from fixing belt 72. Gear portion 96a separates from gear 92, thereby interrupting the transmission of a drive force to fixing belt 72. On the other hand, when movable frame 5 is opened, the previously mentioned air-suction belt 66 is rotated downward on shaft 66a, and at this time side panel 67 presses against the left end of lever 99 so as to rotate lever 99 in a counterclockwise direction. At the same time, lever 98 is rotated in a clockwise direction so as to move shaft 93 together with lever 94, and separate bottom roller 71 from fixing belt 72. Gears 96 and 92 are separated in the previously described manner.

In other words, in the present embodiment, when front movable frame 5 is opened, horizontal feed path 65 and fixing device 70 are also opened. When back cover 3 is opened, fixing device 70 is also opened. Paper jams and the like can be even more easily handled by opening both the front and back to completely open fixing device 70. Paper jams in fixing device 70 can also be readily handled at the back of printer body 1 by opening the light back cover 3 without opening the heavy front movable frame 5.

Unit drive systems

Photosensitive member 11 of photosensitive unit 10 and intermediate transfer belt 41 of intermediate transfer unit 40 are rotatably driven in the arrows a and b directions, respectively. Drive systems are provided on positioning panel 85 to transmit the drive forces to said units.

As shown in FIG. 5, gears 101, 102, and 103 are provided on positioning panel 85 as a drive system for intermediate transfer belt 41, wherein gear 103 is connected to gear 48 fixedly mounted on shaft 42a of support roller 42 via gear 104 provided on shaft 82 of movable frame 5. Gear 104 is rotated in a clockwise direction when a rotational drive force is actuated, and this rotational drive force is exerted in the arrow F1 direction on intermediate transfer unit 40, such that shaft 43a is pushed toward channel 85b. Intermediate transfer unit 40 is accurately positioned on movable frame 5 by means of this pushing action.

On the other hand, gears 105, 106, and 107 are provided on positioning panel 85 as a drive system for photosensitive drum 11, wherein gear 107 is rotated in a counterclockwise direction when a rotational drive force is actuated, and this rotational drive force is exerted in the arrow F2 direction on photosensitive unit 10, such that shaft 11a is pushed toward channel 85a. Photosensitive member unit 10 is accurately positioned on movable frame 5 by means of this pushing action.

Gears 101 and 105 are driven in rotation by a single motor not shown in the drawings.

Support rollers 42 and 43 of intermediate transfer belt 41 have diameters equal to the diameter of photosensitive drum 11 (i.e., 30 mm). This allows intermediate transfer belt 41 and photosensitive drum 11 to be easily rotated at equal peripheral speeds. Providing a smaller diameter for support roller 43 of the secondary transfer section is particularly effective at improving the separation characteristics of the recording sheet S from the intermediate transfer belt 41 at the secondary transfer section.

Cleaning blade operating mechanism

Figure 8:
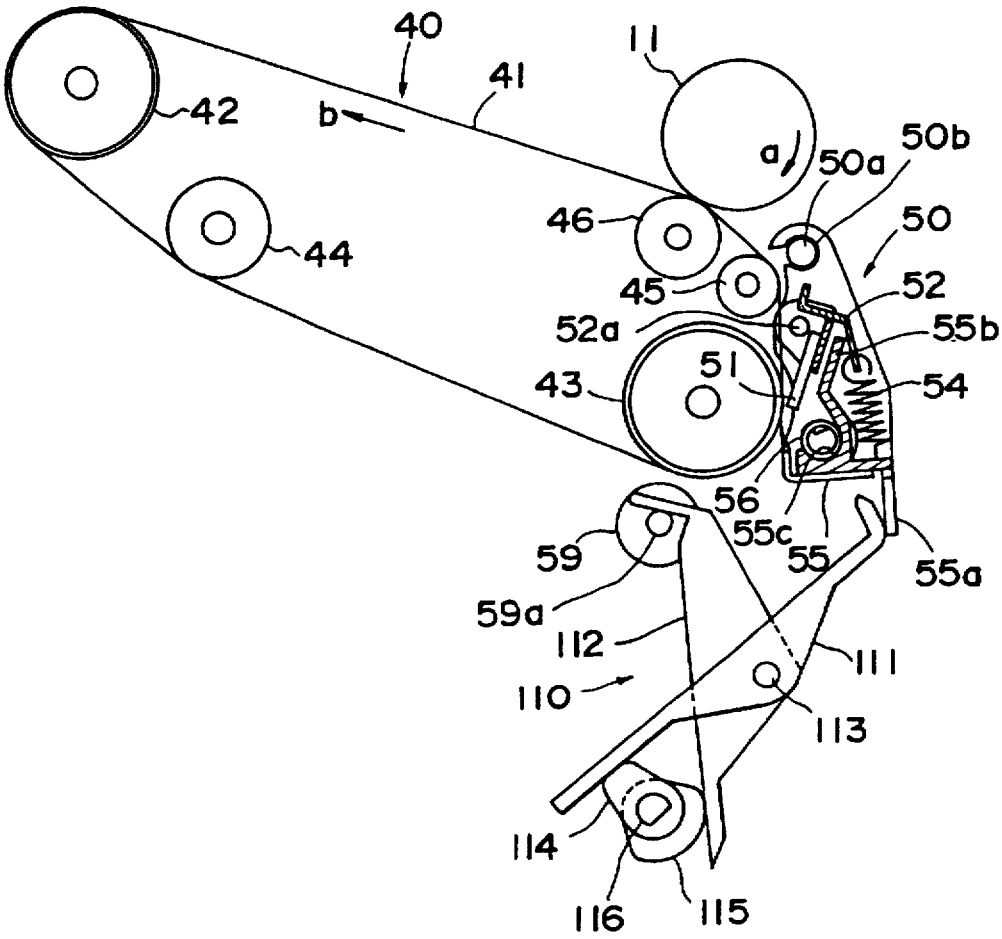
FIG. 8 is a section view showing the intermediate transfer belt cleaner in the non-contact state.

Cleaner 50 for removing residual toner from intermediate transfer belt 41 comprises a blade 51, blade holder 52, coil spring 54, and housing 55, as shown in FIG. 8. Housing 55 is mounted on intermediate transfer unit 40 so as to be rotatable on pin 50a. Holder 52 is integratedly attached to blade 51 and mounted on housing 55 so as to be rotatable on pin 52a, and is forced in a clockwise direction by coil spring 54.

On the other hand, an operating mechanism 110 (described later) is provided below cleaner 50 and is mounted on stationary frame 2, wherein the top end of a first lever 111 engages protrusion 55a of housing 55. Cleaner 50 is forced in a clockwise direction by torsion spring 50b coiled around pin 50a, such that when intermediate transfer unit 40 is set at a predetermined position in body 1, cleaner 50 is controllably positioned by protrusion 55a of housing 55 which abuts the top end of first lever 111. At this time, holder 52 is regulated by riser 55b of housing 55, such that blade 51 is separated from intermediate transfer belt 41 (refer to FIG. 8).

Figure 9:
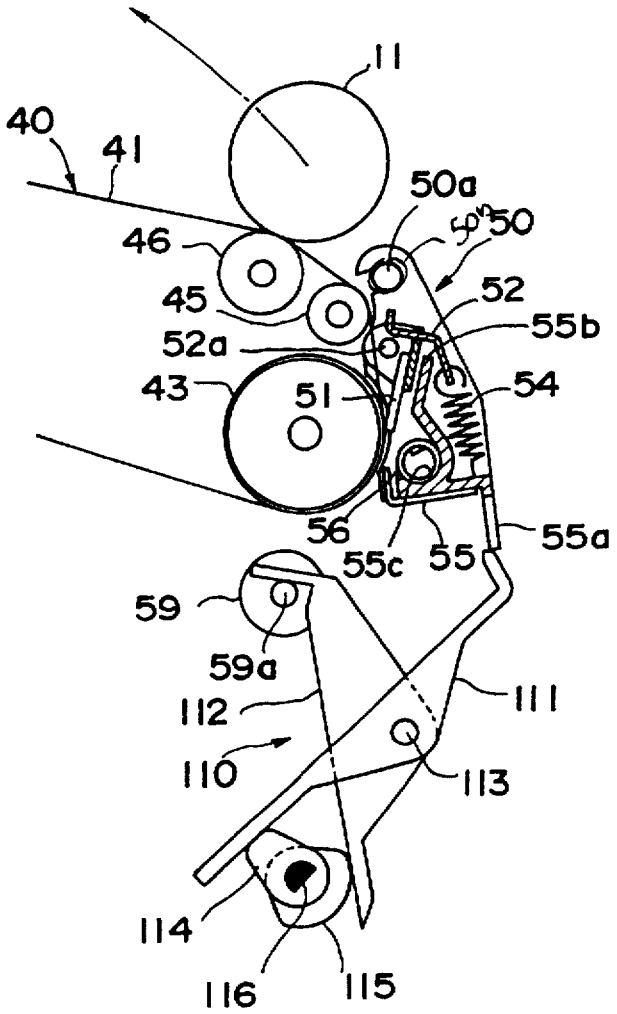
FIG. 9 is a section view showing the intermediate transfer belt cleaner in the contact state.

When movable frame 5 is opened, protrusion 55a of housing 55 is separated from first lever 111, cleaner 50 is rotated somewhat in a clockwise direction via the spring force of torsion spring 50b, and the leading edge of blade 51 presses against intermediate transfer belt 41 (refer to FIG. 9). The contact pressure of blade 51 is applied by coil spring 54. The waste toner removed from intermediate transfer belt 41 by blade 51 is accommodated in toner receptacle 55c of housing 55. When movable frame 5 is opened as shown in FIG. 3, intermediate transfer unit 40 lifts cleaner 50 upward. At this time, blade 51 remains separated from intermediate transfer belt 41 such that waste toner may leaks from a gap formed therebetween. In the present embodiment, however, blade 51 is pressed against intermediate transfer belt 41 when protrusion 55a of housing 55 and first lever 111 are separated at the start of the opening operation, thereby preventing waste toner leakage.

Blade and secondary transfer roller separation mechanism

Figure 10:
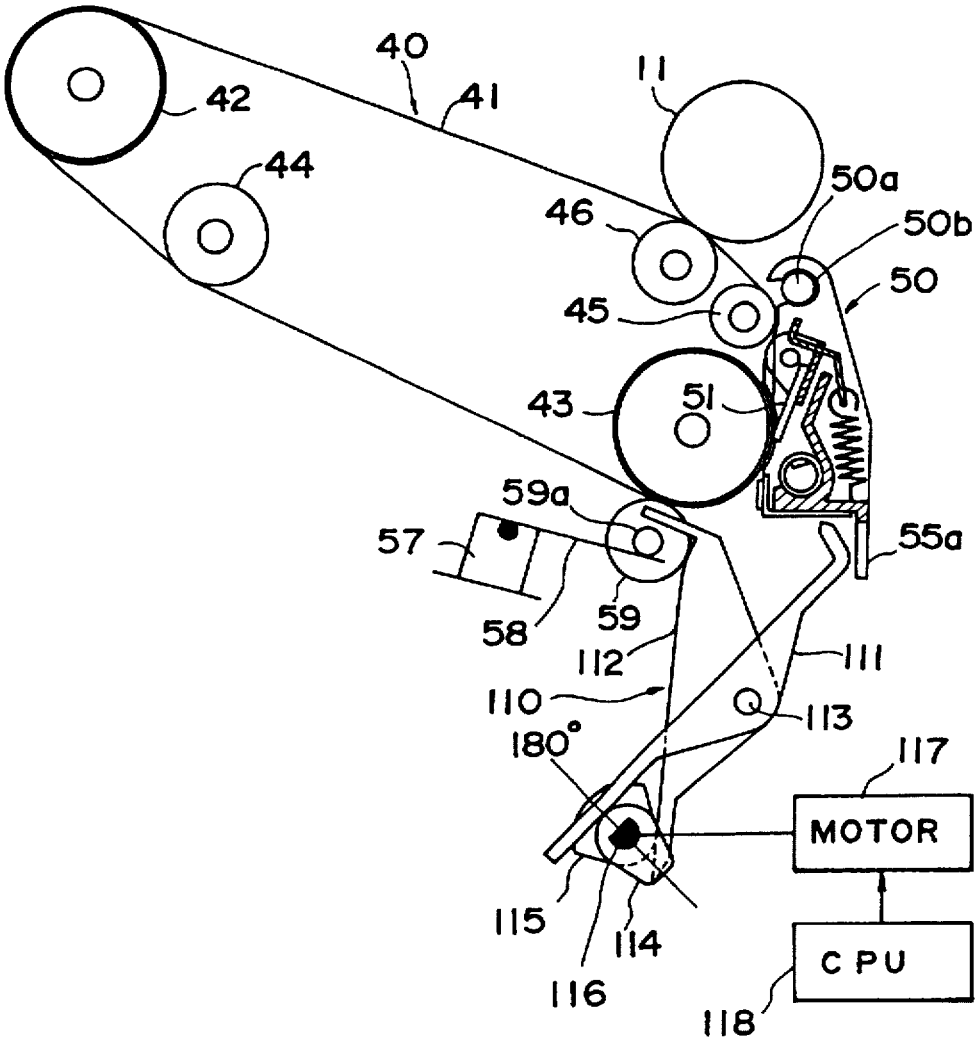
FIG. 10 is an illustration showing the blade/transfer roller contact/release mechanism with the blade and transfer roller in the contact state.

Blade 51 and secondary transfer roller 59 must be separated from intermediate transfer belt 41 during non-printing time, and during printing time until the four color toner images are overlaid on intermediate transfer belt 41 (refer to FIGS. 8 and 11), and press against intermediate transfer belt 41 only during the secondary transfer operation (refer to FIG. 10). When toner concentration is automatically controlled, a test pattern for each color toner is sequentially formed on intermediate transfer belt 41 and transferred in primary transfers. At this time, blade 51 must press against intermediate transfer belt 41 to remove toner, but conversely secondary transfer roller 59 is retracted such that toner soiling must be prevented (refer to FIG. 12). A well-known AIDC (automatic image density control) method is used to automatically control the toner concentration by optically detecting the density of the test patterns.

Figure 11:
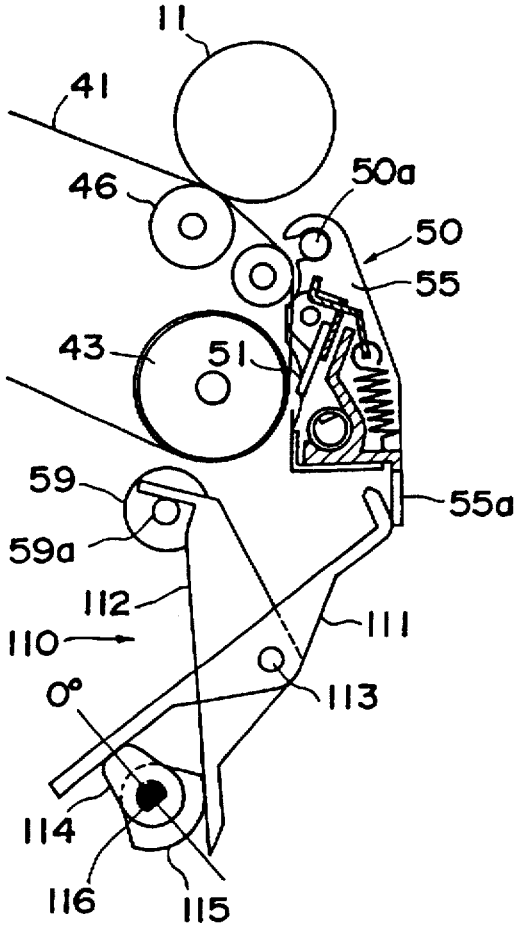
FIG. 11 is an illustration showing the blade/transfer roller contact/release mechanism with the blade and transfer roller in the released state.
Figure 12:
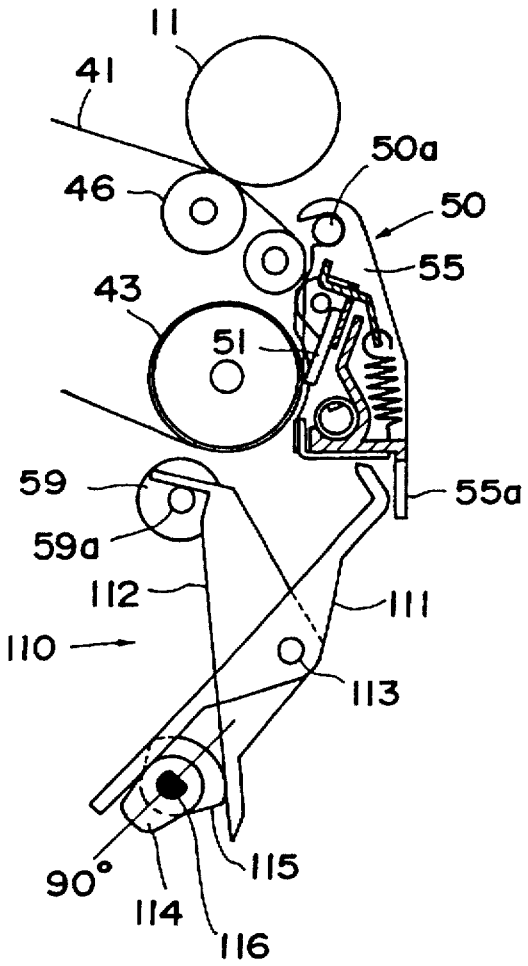
FIG. 12 is an illustration showing the blade/transfer roller contact/release mechanism with the blade in a contact state and the transfer roller in a released state.

Retraction control mechanism 110 controls the contact and retraction of blade 51 and secondary transfer roller 59 as shown in FIGS. 10, 11, and 12.

That is, first lever 111 and second lever 112 are provided on shaft 113 so as to be rotatable, and first cam 114 and second cam 115 are fixedly mounted to cam shaft 116. The leading end of first lever 111 abuts protrusion 55*a* of cleaner 50, and its angle of rotation is controlled by first cam 114. The leading end of second lever 112 abuts shaft 59*a* of secondary transfer roller 59, its angle of rotation is controlled by second cam 115. Cam shaft 116 is connected to a reversible motor 117 via a speed reducing mechanism not shown in the drawings, and motor 117 is controlled by CPU 118. Secondary transfer roller 59 is mounted on holder 57 so as to be forced upward by a flat spring 58.

Normally, cams 114 and 115 are positioned at an angle of rotation of zero degrees as shown in FIG. 11. At this time, the leading end of first lever 111 abuts protrusion 55*a* of cleaner 50, thereby controlling housing 55, such that blade 51 is retracted from intermediate transfer belt 41. The leading end of second lever 112 presses against shaft 59*a*, thereby separating secondary transfer roller 59 from intermediate transfer belt 41.

When cams 114 and 115 are rotated 180°, first lever 111 is rotated slightly in a counterclockwise direction such that the leading end of lever 111 is separated from protrusion 55*a*, as shown in FIG. 10. Thus, cleaner 50 is rotated slightly in a clockwise direction on pin 50*a*, such that the leading edge of blade 51 is pressed against intermediate transfer belt 41. Second lever 112 is rotated slightly in a clockwise direction, such that the leading end of lever 112 is separated from shaft 59*a*. Thus, secondary transfer roller 59 is lifted by the spring force of flat spring 58 so as to press against intermediate transfer belt 41. Levers 111 and 112 and cams 114 and 115, when set as shown in FIG. 10, allow the four color toner image overlaid on intermediate transfer belt 41 to be transferred to recording sheet S.

When cams 114 and 115 are rotated from 0° to 90° in a counterclockwise direction, first lever 111 is rotated slightly in a counterclockwise direction, such that the leading end of said lever 111 is separated from protrusion 55*a*, as shown in FIG. 12. Thus, cleaner 50 is slightly rotated on pin 50*a* in a clockwise direction, such that the leading end of blade 51 presses against intermediate transfer belt 41. Second lever 112 is maintained at a position equal to an angle of rotation of zero degrees, such that secondary transfer roller 59 remains retracted from intermediate transfer belt 41. Levers 111 and 112, and cams 114 and 115 are set at the positions indicated in FIG. 12 which AIDC is executed.

Retraction mechanism control sequence

Figure 13:
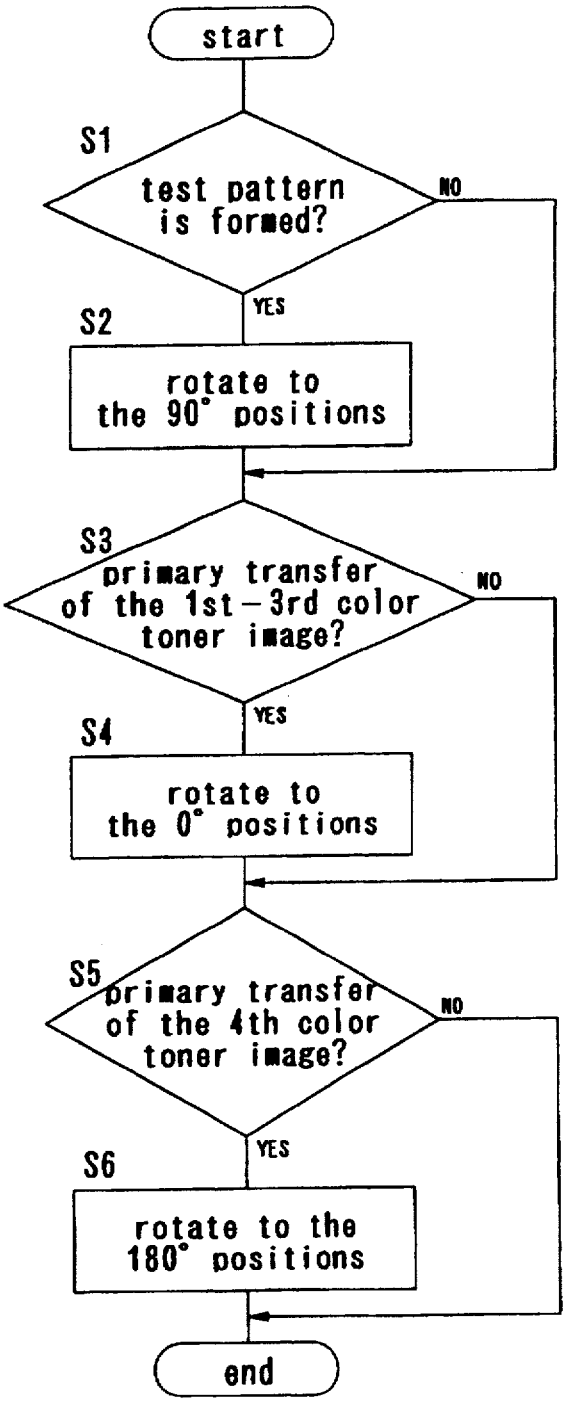
FIG. 13 is a flow chart showing the control sequence of the blade/transfer roller contact/release mechanism.

The control sequence of the aforesaid retraction mechanism is described hereinafter with reference to the flow chart of FIG. 13.

This control is accomplished by controlling motor 117 via CPU 118.

In step S1, a check is made to determine whether or not a test pattern has been formed. The test pattern is a pattern of an electrostatic latent image of a specific area formed on the surface of photosensitive drum 11 by laser scanning unit 20 and developed by a developing device for AIDC. The test patterns are sequentially developed by the four color developing devices, and their densities are optically detected. When the test pattern is formed, in step S2, cams 114 and 115 are rotated to the 90° positions shown in FIG. 12. The test patterns are sequentially transferred onto intermediate transfer belt 41 in a primary transfer, then removed by blade 51. At this time, secondary transfer roller 59 is retracted from intermediate transfer belt 41, so as to not be soiled by the toner of the test patterns.

Then, when a full color printing operation starts and a determination is made that primary transfer of the 1st–3rd color toner images has been made in step S3, cams 114 and 115 are returned to the zero degree angle of rotation position shown in FIG. 11 in step S4. At this time, blade 51 and secondary transfer roller 59 are retracted from intermediate transfer belt 41, such that the toner images are overlaid on intermediate transfer belt 41 without hindrance.

When it is determined in step S5 that the primary transfer of the fourth color toner image has been accomplished, cams 114 and 115 are rotated to the 180° rotation position shown in FIG. 10 in step S6. Thus, blade 51 and secondary transfer roller 59 are pressed against intermediate transfer belt 41. Furthermore, a recording sheet is fed from paper supply section 60. Accordingly, the full color image formed on intermediate transfer belt 41 is transferred onto recording sheet S in a secondary transfer, and the residual toner is removed by blade 51.

Waste toner processing

In full color image formation, waste toner is generated at two locations, i.e., photosensitive drum 11 and intermediate transfer belt 41. Conventionally, waste toner boxes have been provided at these two locations. In such an arrangement, however, maintenance by a user is difficult. In the present embodiment, as shown in FIG. 2, waste toner removed from photosensitive drum 11 by cleaner 13 is accommodated in waste toner compartment 14 provided behind said cleaner 13, and waste toner removed from intermediate transfer belt 41 by cleaner 50 is also transported to said compartment 14 so as to be accommodated therein. Photosensitive unit 10 is replaced after a predetermined length of use, and waste toner is also removed from the printer at the time of this replacement, thereby simplifying maintenance by the user.

Figure 14:
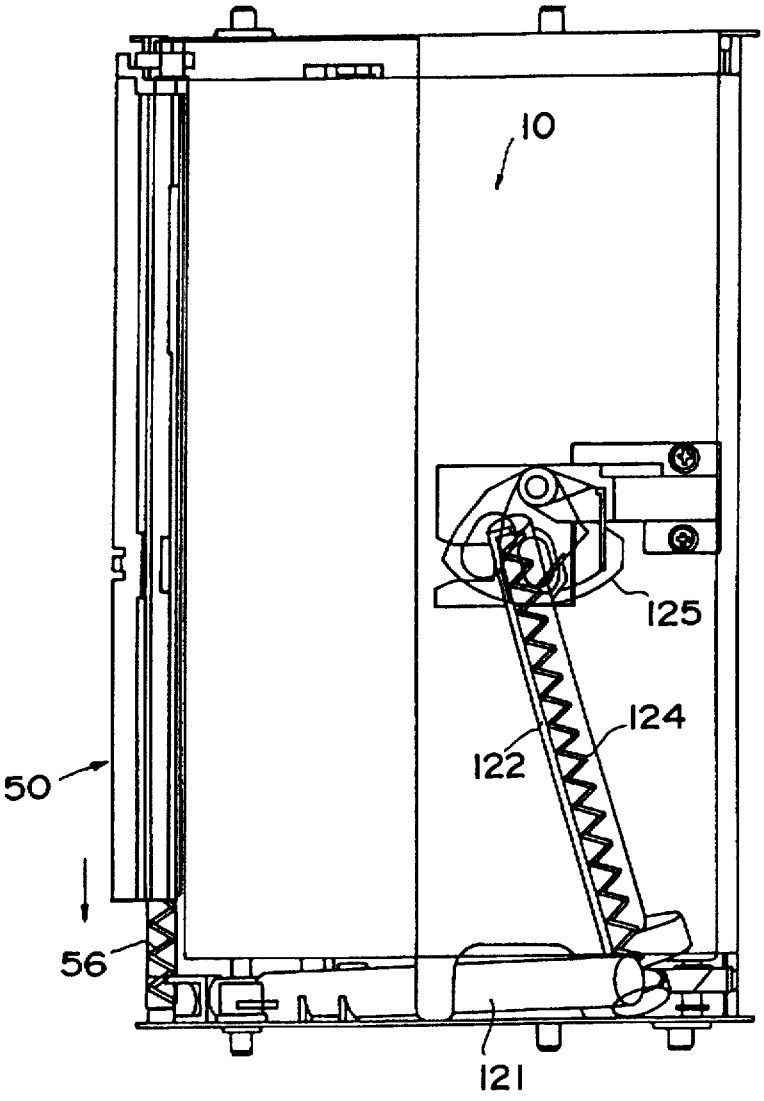
FIG. 14 is a top view of the waste toner transport device.
Figure 15:
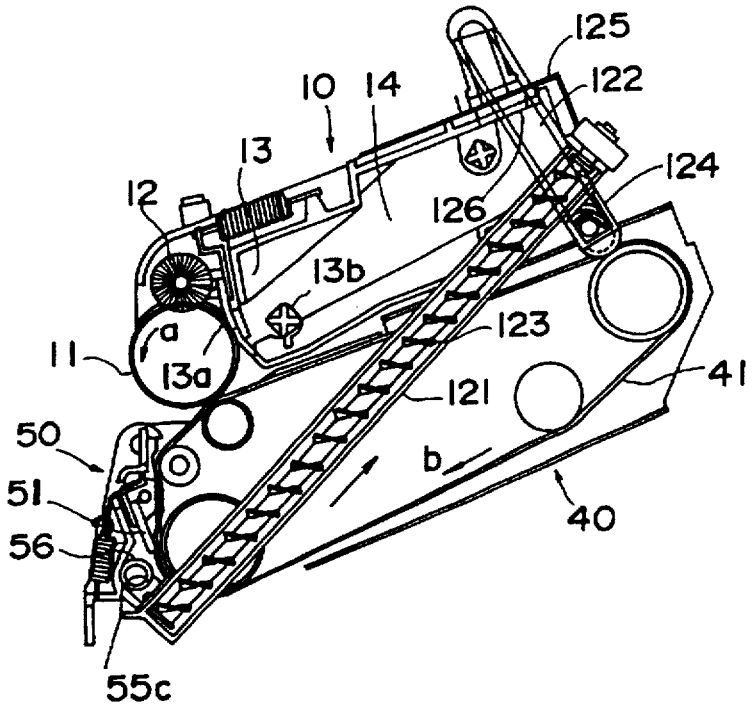
FIG. 15 is a side view of the waste toner transport device.

Specifically, as shown in FIGS. 14 and 15, a first feed pipe 121 and second feed pipe 122 are provided behind intermediate transfer unit 40. First feed pipe 121 is provided with an internal transport screw 123, and second feed pipe 122 is provided with an internal transport coil 124, both of which are rotatable. The bottom end of first feed pipe 121 communicates with one end of receptacle 55*c* of cleaner 50, and the top end communicates with the bottom of second feed pipe 122. Second feed pipe 122 extends from the back of photosensitive unit 10 to the center of the top surface, and the leading end communicates with the rear top surface of waste toner compartment 14.

Waste toner removed in receptacle 55c of cleaner 50 is transported to an area below first feed pipe 121 by transport coil 56. This waste toner is fed into first feed pipe 121 by transport screw 123, and is introduced into second feed pipe 122. The waste toner is transported inside second feed pipe and accommodated in the toner compartment 14.

The exit aperture of second feed pipe 122 is provided with a shutter 125. Shutter 125 closes the exit aperture of second feed pipe 122 to prevent waste toner leakage when photosensitive unit 10 is removed from movable frame 5. Furthermore, a shutter 126 is provided at the waste toner entrance aperture of photosensitive member unit 10. Shutter 126 prevents waste toner leakage from compartment 14 by covering the waste toner entrance aperture when photosensitive member unit 10 is removed from movable frame 5.

Cleaning blade set conditions

In the present embodiment, cleaning blade 51 is set according to the following conditions. Intermediate transfer belt 41 is formed of a material containing fluorine atoms in polycarbonate. The system speed (peripheral speed of the intermediate transfer belt 41) is set at 85 mm/sec.

Blade 51 is formed of urethane rubber (Hokushin Industries, Ltd.) and has a hardness of 67°±3°, its length is 2 mm, the amount of protrusion is 8 mm, its contact pressure is a counter type, its angle of contact is 27°, its linear pressure is 1.25 g/mm, the load is spring pressure, and it undergoes no lateral movement. The life cycle of the cleaning blade is 200,000.

In the aforesaid conditions, intermediate transfer belt 41 was diminished 3/200 μm in 1,000 cycles. Thus, toner filming of the surface of belt 41 was prevented. Results of experiments to determine the lifecycle of 200,000 disclosed no filming on the surface of belt 41 while excellent cleaning characteristics were maintained. Belt 41 was diminished about 3 μm, and surface roughness was about 1.2 μm (Rmax). Primary transfer efficiency and secondary transfer efficiency were both maintained at 90% and higher.

In other experiments, the surface of belt 41 was set at a local roughness of 2.4 μm or greater, images were adversely affected. The limit of surface roughness is 2 μm. In the present embodiment, the surface roughness of belt 41 at the end of its lifecycle was 1.2 μm, (Rmax), and primary transfer efficiency and secondary transfer efficiency were both 90% or higher, with no adverse affects on the images.

Figure 16:
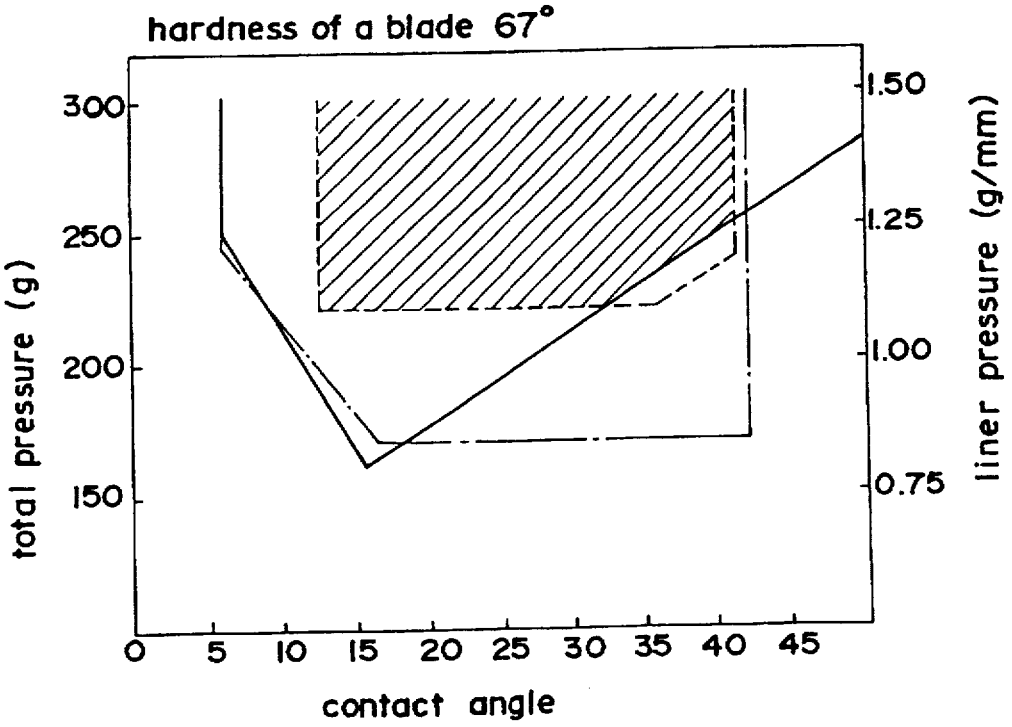
FIG. 16 is a graph showing the set conditions of the clearing blade (hardness 67°)

FIG. 16 is a graph showing cleaning characteristics of a blade having a hardness of 67°; the horizontal axis indicates the contact angle, and the vertical axis indicates the total pressure and linear pressure. The region circumscribed by the dash-dot line is the region of excellent cleaning ability at low temperature (10° C.) and low humidity (15%). The region circumscribed by the solid line is the region of excellent cleaning ability at standard temperature (25° C.) and standard humidity (60%). The region circumscribed by the dashed line is the region of excellent cleaning ability at high temperature (30° C.) and high humidity (85%). Accordingly, normally excellent cleaning ability can be obtained if the blade settings fall within the shaded region in FIG. 16.

Figure 17:
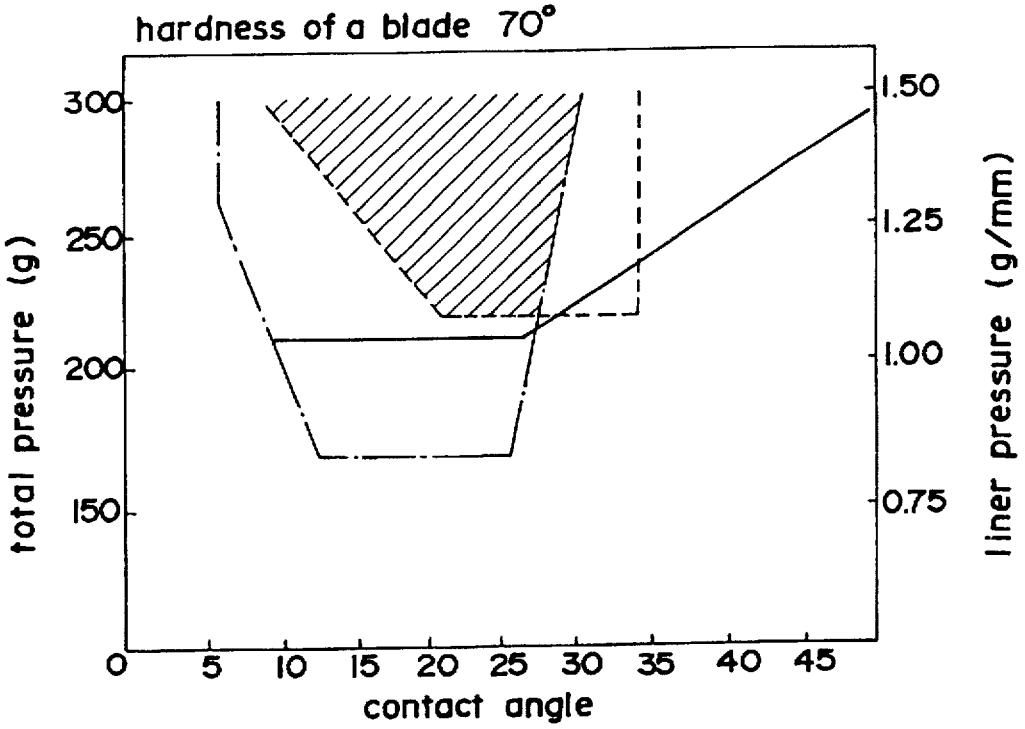
FIG. 17 is a graph showing the set condition of the cleaning blade (hardness 70°)

FIG. 17 shows cleaning ability when a blade of 70° hardness is used; the regions are formed as described in FIG. 16. In this case, normally excellent cleaning ability is obtained if the blade settings fall within the shaded region.

The load applied by blade 51 is not limited to the spring pressure type insofar as a target linear pressure can be obtained. The portion applying blade pressure contact on intermediate transfer belt 41 is backed up by support roller 43, but such backup is not required. Although blade 51 moves integratedly with housing 55 so as to separate from intermediate transfer belt 41, blade 51 and housing 55 may be moved independently, and the nature of said movement need not be rotational and may be linear. Further modifications are possible insofar as the contact angle and linear pressure remain on target.

Developing device shutter

Developing device 31 can be removed from developing unit 30 when movable frame 5 is opened. At this time, shutter 130 is provided on each developing device 31 to protect developing sleeve 32. Developing sleeve 32 must be protected from contact with foreign matter and the user to prevent oil adhering to the sleeve so as to maintain developing characteristics. When removed for replacement, this shutter also prevents soiling of the hands of the operator to toner adhering to developing sleeve 32.

Figure 18:
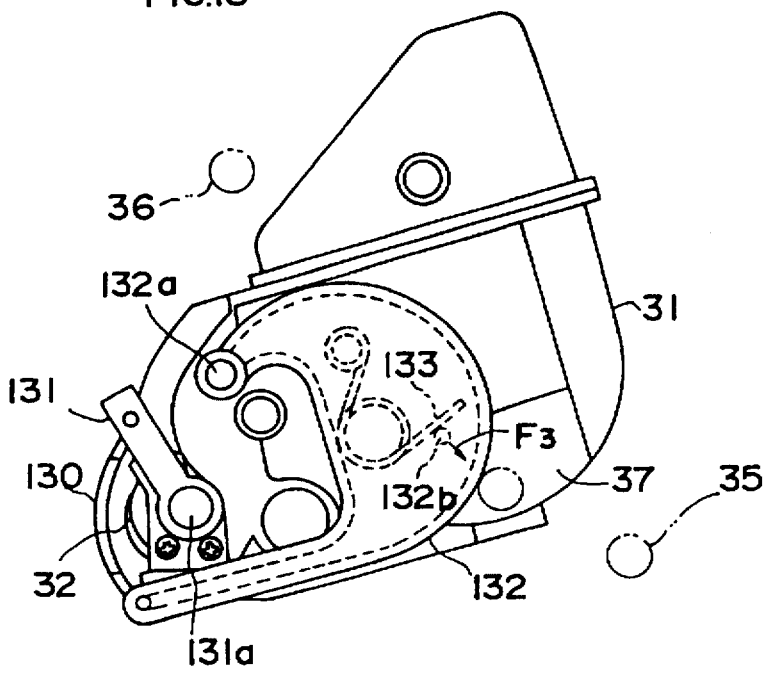
FIG. 18 is a side view of the developing device with the shutter in the closed state.
Figure 19:
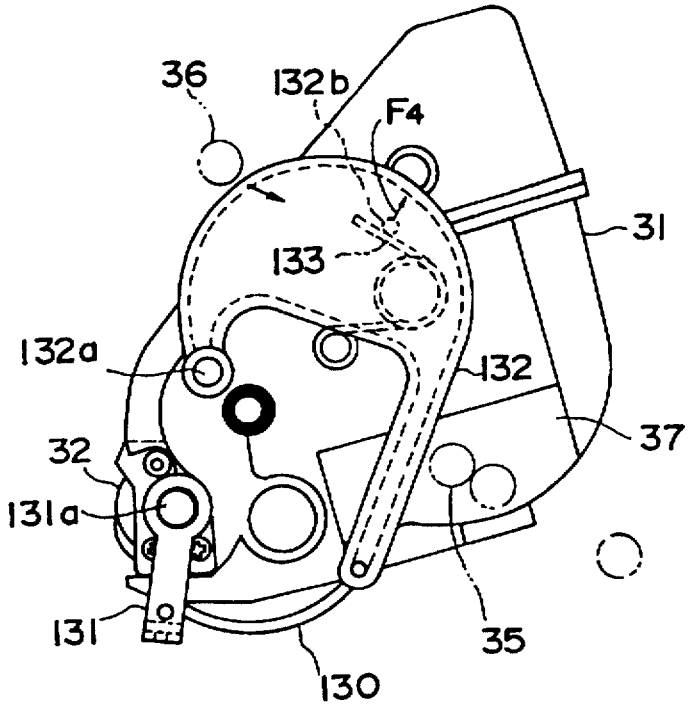
FIG. 19 is a side view of the developing device with the shutter in the released state.

Specifically, as shown in FIGS. 18 and 19, shutter 130 has a curved shape, and one end is connected to lever 131, and the other end is connected to arm 132. Lever 131 is rotatable about pin **131*a* provided on housing 37, and arm 132 is also rotatable about pin 132*a* provided on housing 37. Arm 132 is pressed against protrusion 132*b* by the force exerted by the leading end of torsion spring 133. The direction of this force is variable in accordance with the angle of rotation of arm 132**.

FIG. 18 shows developing device 31 removed from developing unit 30. At this time, arm 132 is rotated in a clockwise direction about pin **132*a* via the action of the spring force of torsion spring 133 in the arrow F3 direction with respect to protrusion 132*b*. Shutter 130 is rotated in a clockwise direction in accordance with the aforesaid rotation, so as to cover and protect developing sleeve 32**.

On the other hand, when developing device 31 is installed in developing unit 30, arm 132 abuts pin 35 provided on rack panel 34 (refer to FIG. 4), such that arm 132 is rotated in a counterclockwise direction and shutter 130 opens developing sleeve 32, as shown in FIG. 19. During loading, the spring force of torsion spring 133 acts in the arrow F4 direction with respect to protrusion **132*b* so as to rotate arm 132 in a clockwise direction, i.e., shutter 130 is moved in a direction to cover developing sleeve 32**.

When developing device 31 is removed, a single pin 36 provided on rack panel 34 abuts arm 132, such that arm 132 is rotated in a clockwise direction. Thus, shutter 130 covers developing sleeve 32.

In the present embodiment, a single shutter 135 is provided (refer to FIGS. 2 and 3). Shutter 130 performs a protective function when developing device 31 is removed from developing unit 30, but does not protect access to developing sleeve 32 from outside when developing device 31 is installed in unit 30 and movable frame 5 is open. Shutter 135 protects developing sleeve 32 in the aforesaid state. Shutter 135 is provided on stationary frame 2, and moves in conjunction with the opening/closing operation of movable frame 5. That is, as shown in FIG. 3, when movable frame 5 is opened, shutter 135 is moved in front of developing sleeve 32 by a member not shown in the drawing, so as to protect developing sleeve 32. On the other hand, when movable frame 5 is closed, shutter 135 is retracted downward to open the developing section, as shown in FIG. 2.

Photosensitive unit shutter

Figure 20:
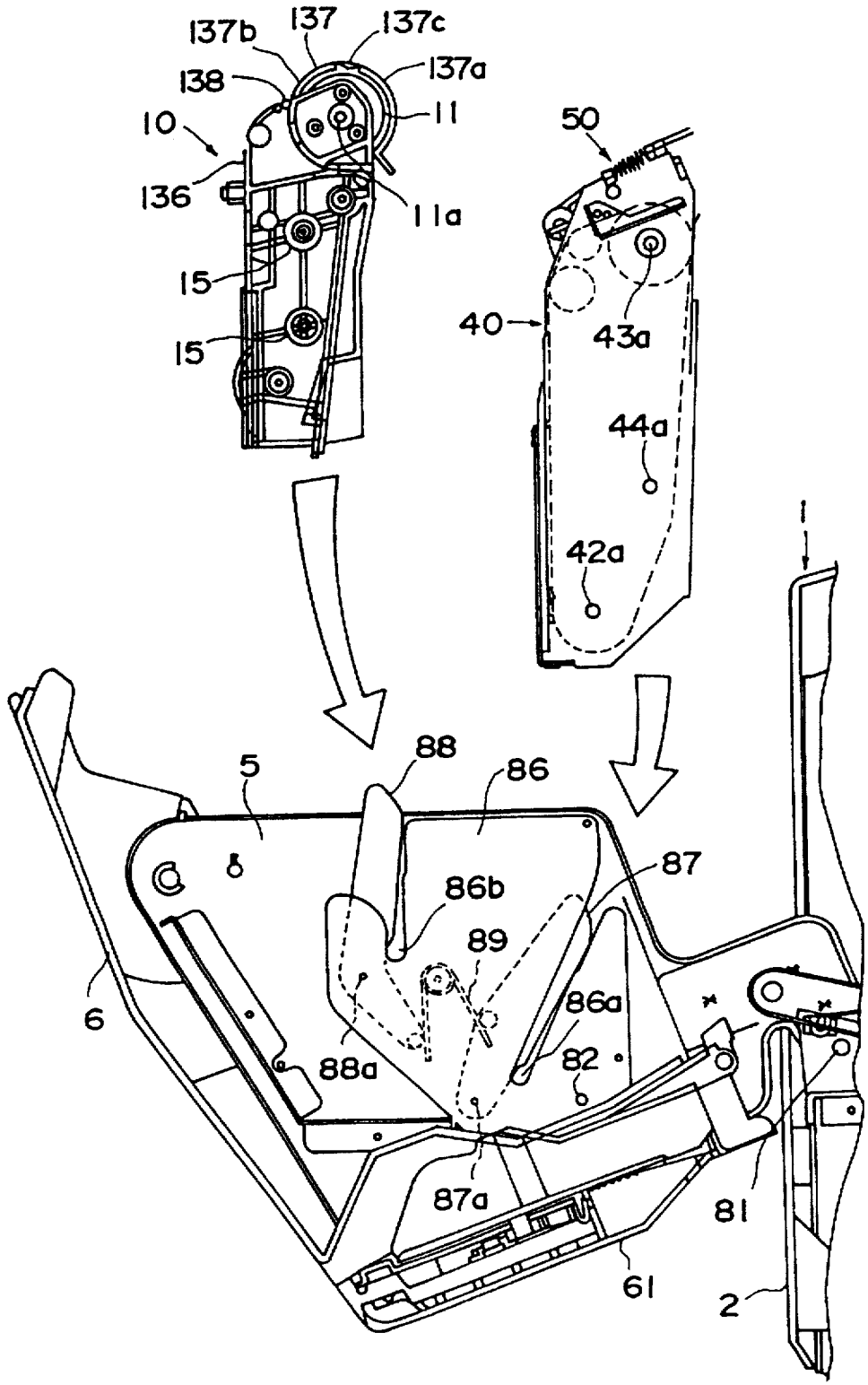
FIG. 20 is a side view of the essential portion showing shutter of the photosensitive unit in the removed state.
Figure 21:
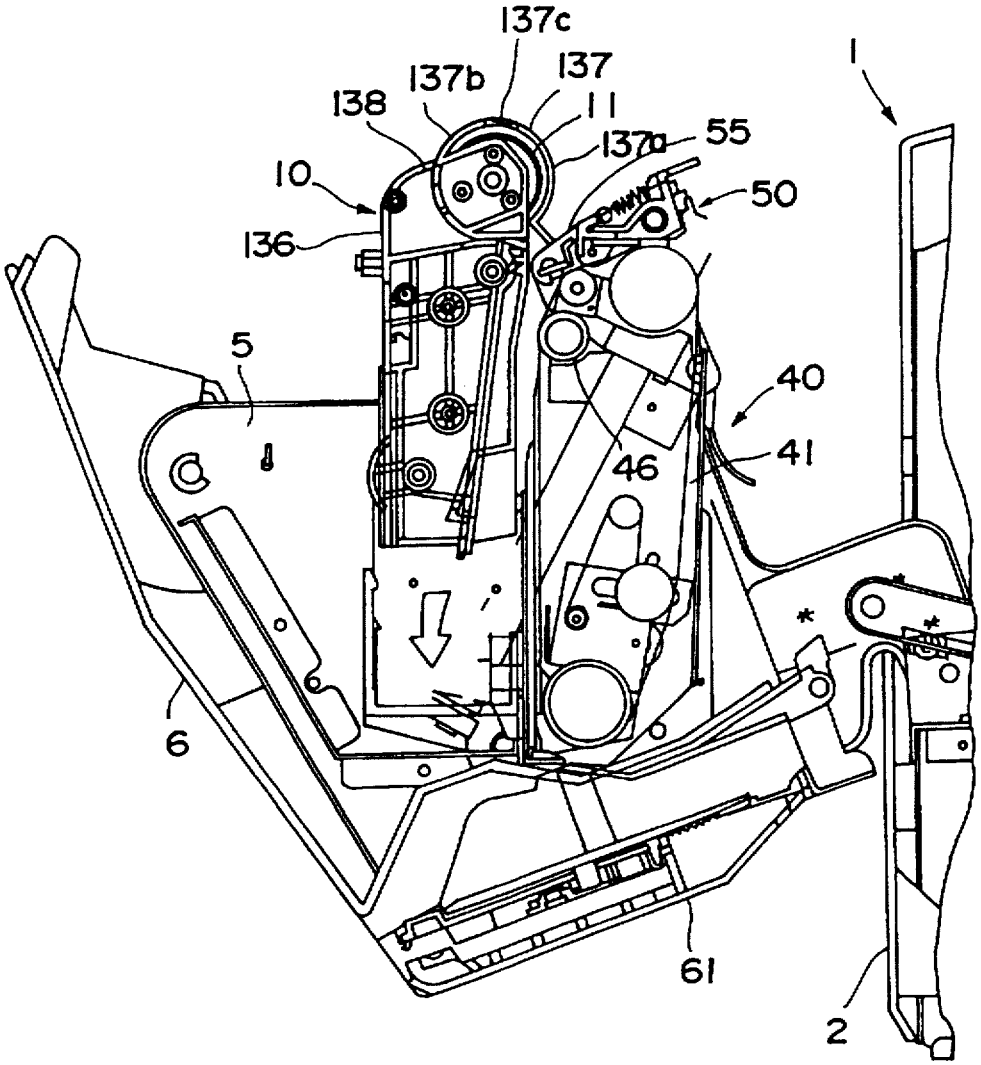
FIG. 21 is a side view of the essential portion showing the shutter of the photosensitive unit when said unit is being installed on the movable side frame.
Figure 22:
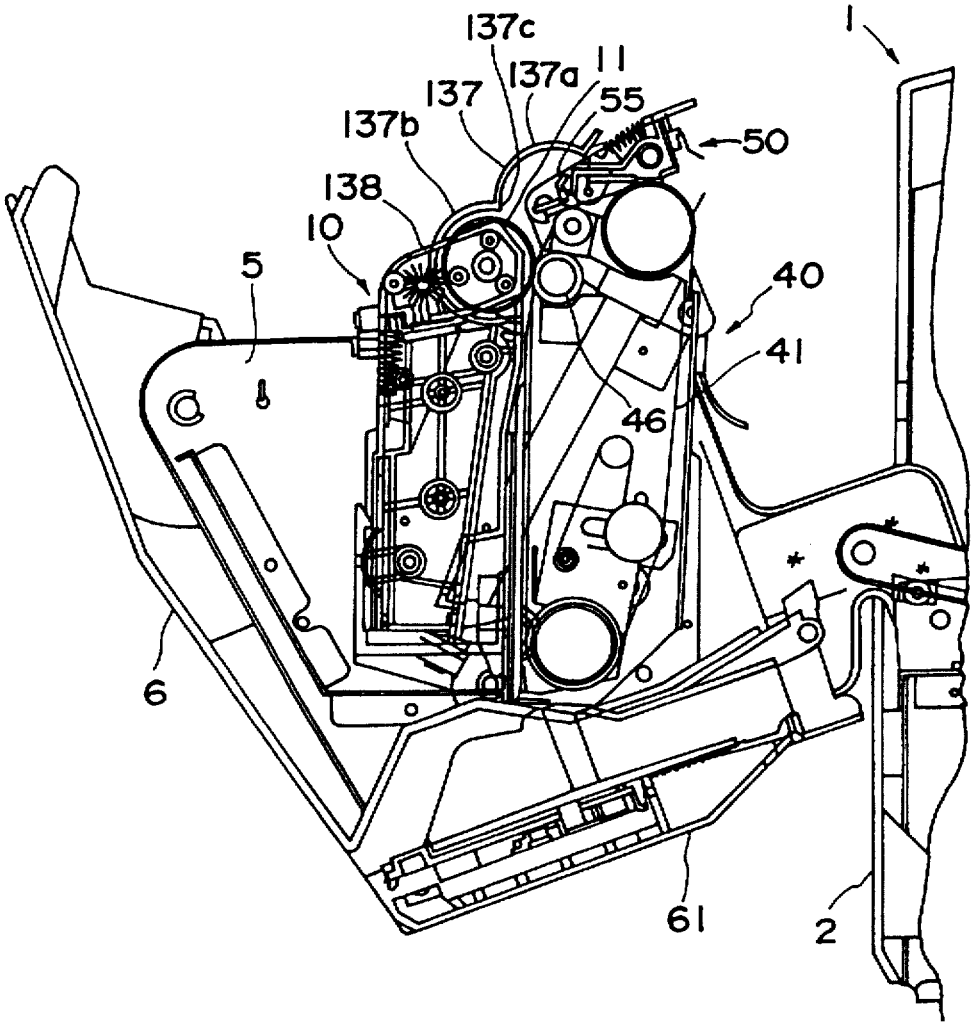
FIG. 22 is a side view of the essential portion showing the shutter of the photosensitive member unit when said unit has been installed on the movable side frame.

Photosensitive unit 10 is provided with a shutter 137 to protect photosensitive drum 11. Shutter 137 comprises a first shutter **137*a* rotatably connected to pin 137*c*, a second shutter 137*b* rotatably mounted on pin 138 of housing 136** of unit 10. Shutter 137 itself exerts a force via its own weight in a clockwise direction about pin 138, such that when photosensitive unit 10 is removed from movable frame 5, the exposure, developing, and primary transfer areas are covered as shown in FIG. 20. When photosensitive unit 10 is installed on movable frame 5, the leading end of first shutter 137*a* abuts cleaner housing 55 of intermediate transfer unit 40, as shown in FIG. 21, and as the installation operation continues, first shutter 137*a* is rotated in a counterclockwise direction by housing 55, so as to open the primary transfer area of photosensitive drum 11 (refer to FIG. 22).

Figure 23:
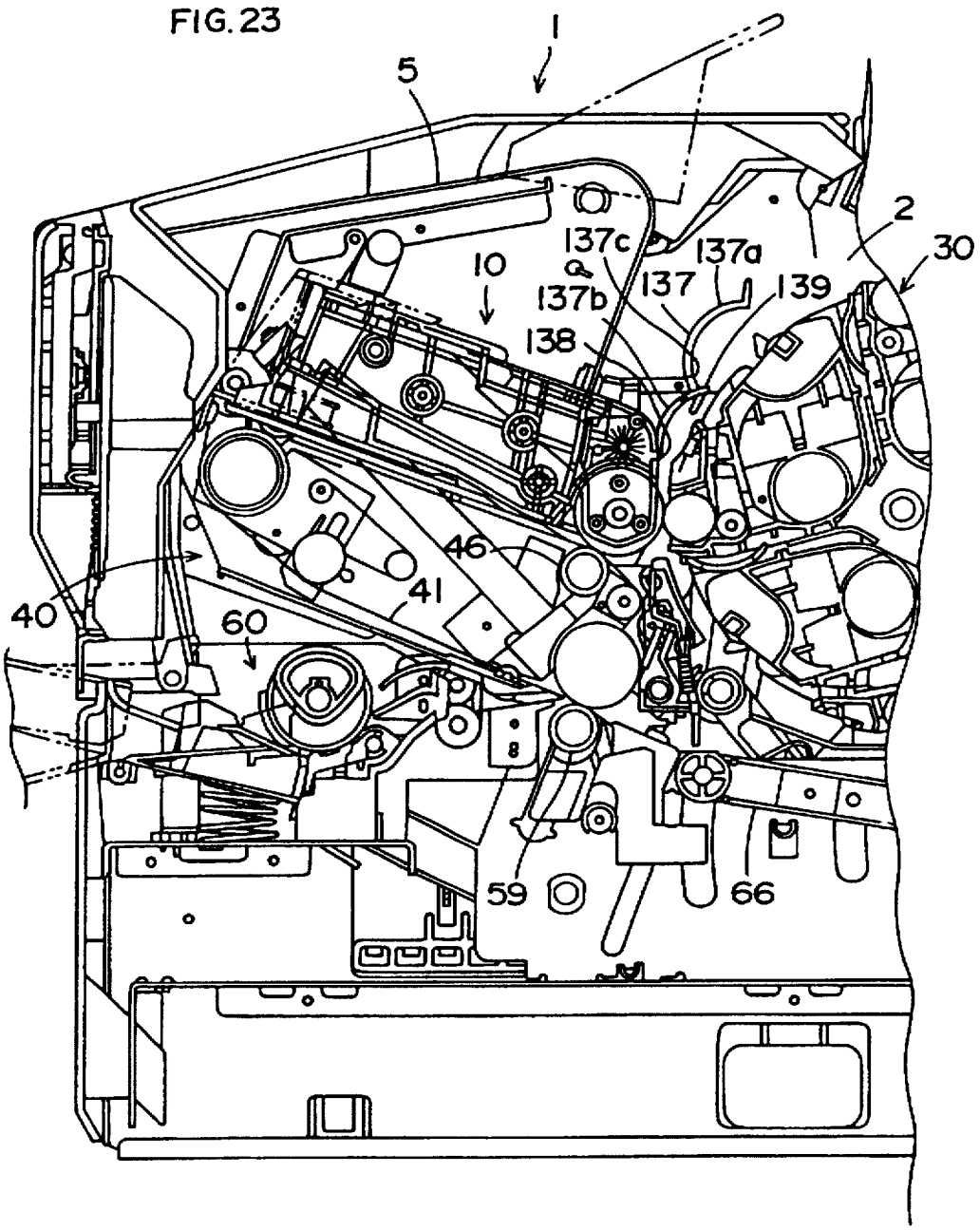
FIG. 23 is a side view of the essential portion showing the shutter of the photosensitive unit when said unit is set in the printer body.

When movable frame 5 is closed, shutter 137 abuts regulating plate 139 provided on stationary frame 2 and is rotated in a counterclockwise direction, as shown in FIG. 23. Thus, the exposure area and developing area of photosensitive drum 11 are opened.

When photosensitive unit 10 is removed by itself, there is some concern that the exposure area, developing area and primary transfer area of photosensitive drum 11 will be exposed, according to the previously described construction, said areas are protected by the use of shutter 137. Moreover, when photosensitive unit 10 and intermediate transfer unit 40 are integrated, it is possible for shutter 137 to open the primary transfer area while intermediate transfer belt 41 is in contact with photosensitive drum 11. When printer body 1 is set at a predetermined position, it is possible for shutter 137 to open the exposure and developing areas, for developing image exposure by laser scanning unit 20 by developing device 31.

Intermediate transfer unit shutter

Intermediate transfer unit 40 is provided with a first shutter 141 and second shutter 145 for protecting intermediate transfer belt 41 as shown in FIGS. 24–28A.

Figure 26:
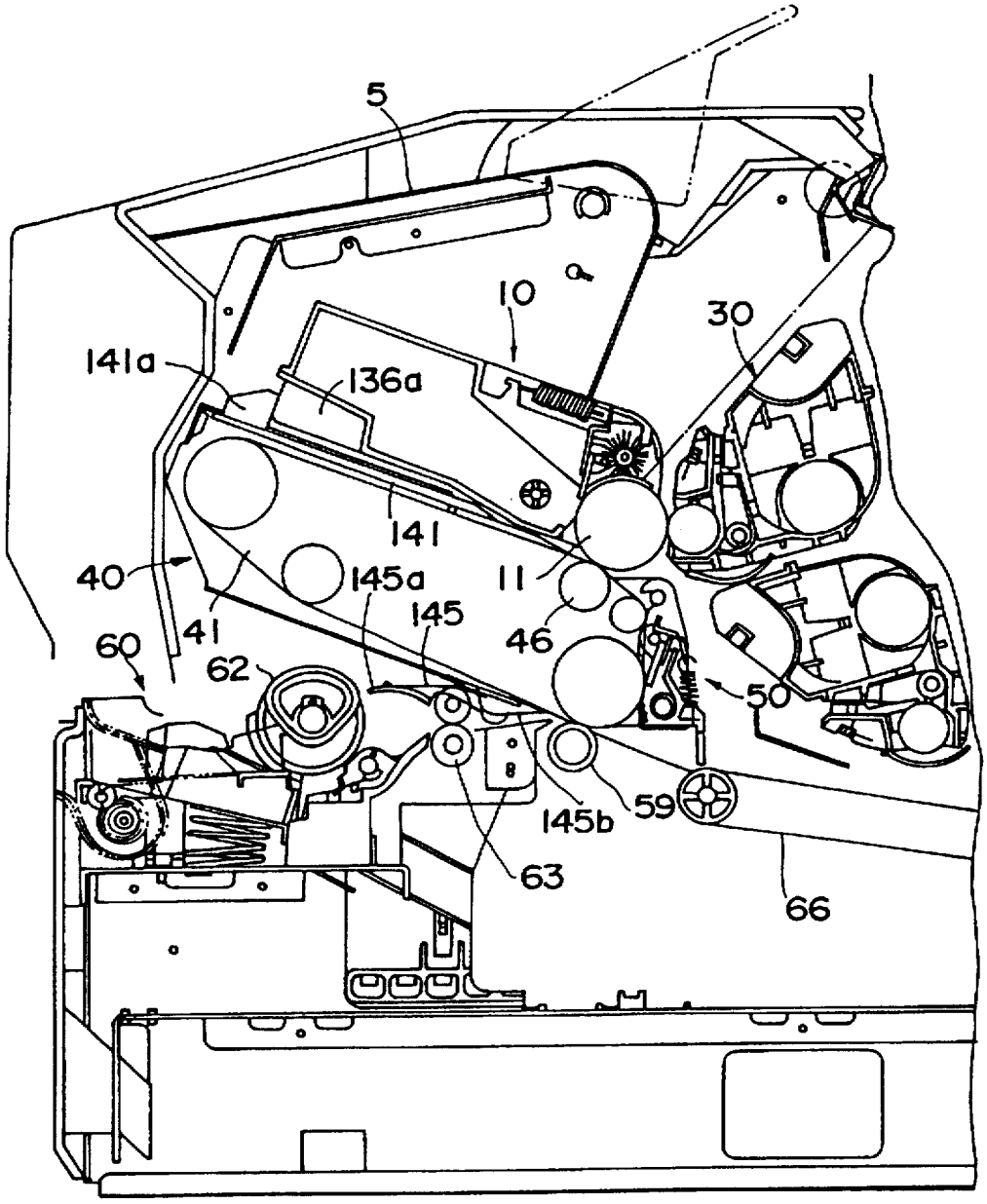
FIG. 26 is a side view of the essential portion showing the first and second shutters of the intermediate transfer unit when said unit is set inside the printer.
Figure 27:
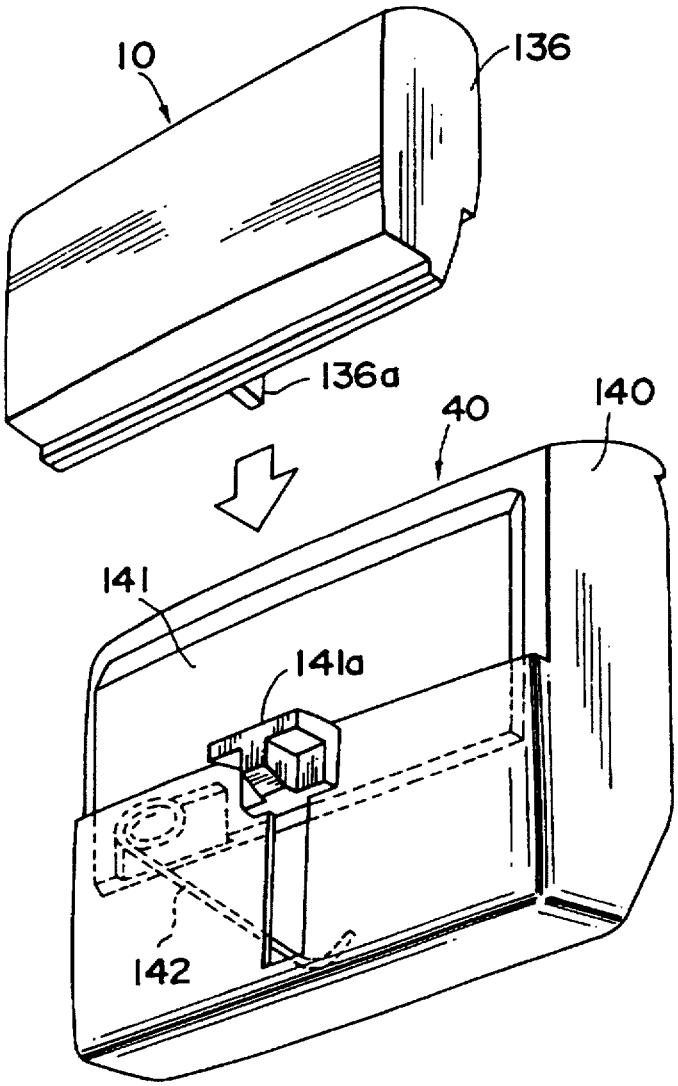
FIG. 27 is a perspective view showing the first shutter.

First shutter 141 protects the primary transfer region of intermediate transfer belt 41, and, as shown in FIG. 27, is provided with a protrusion 141*a* which slides on housing 140 and is normally pushed upward by the force of torsion spring 142. On the other hand, photosensitive unit 10 is provided with a protrusion 136*a* on housing 136 and which can engage protrusion 141*a* of first shutter 141. FIG. 27 shows intermediate transfer unit 40 removed from movable frame 5; at this time, first shutter 141 moves upward by the force applied by torsion spring 142, thereby protecting the primary transfer region of intermediate transfer bet 41. When intermediate transfer unit 40 is installed on movable frame 5 (refer to FIG. 24) and photosensitive unit 10 is installed (refer to FIG. 25), protrusion 136*a* of photosensitive unit 10 engages protrusion 146*a* from above, such that first shutter 141 is pushed downward, so as to open the primary transfer region of intermediate transfer belt 41. Even when movable frame 5 is closed, shutter 141 maintains this open state (refer to FIG. 26.

Figure 24:
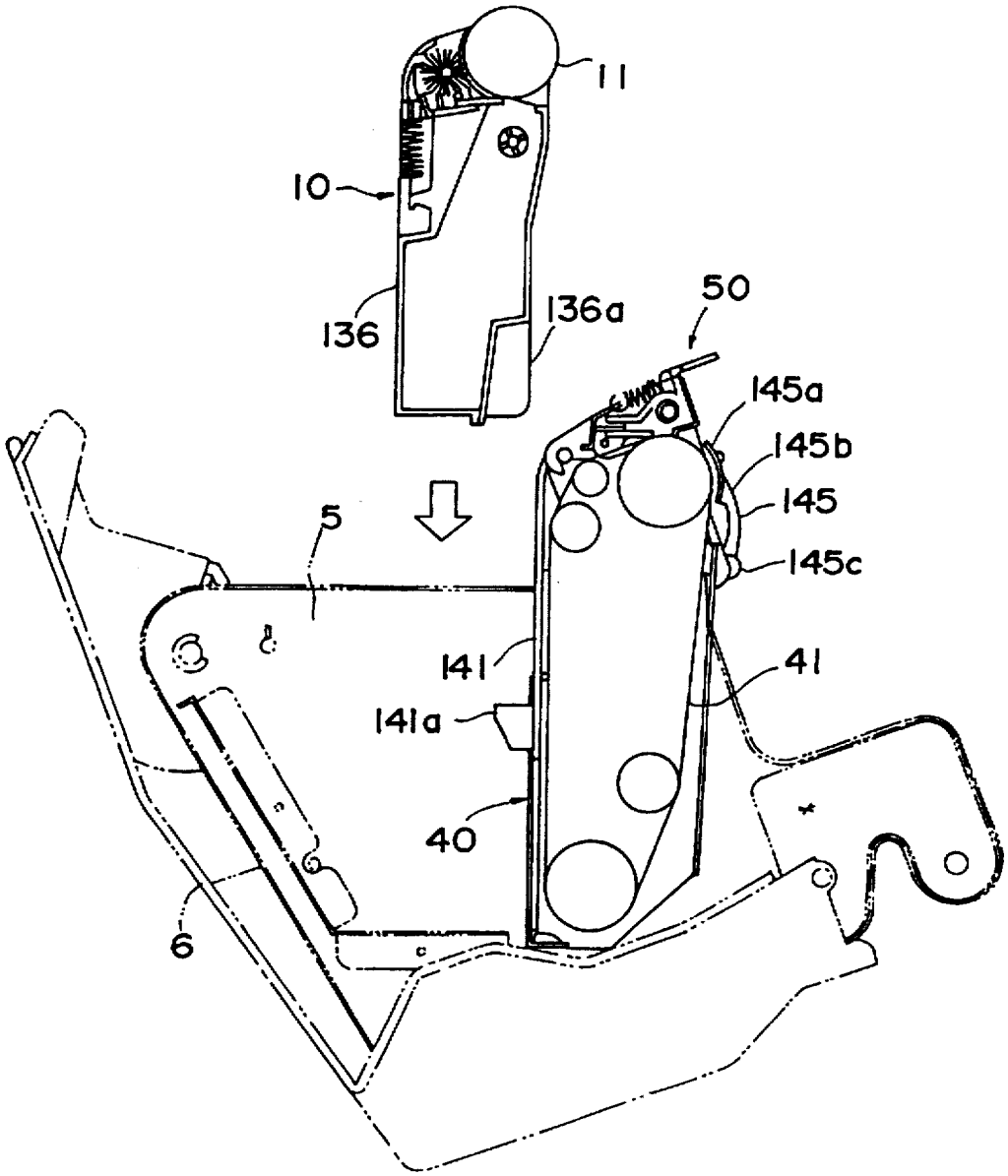
FIG. 24 is a side view of the essential portion showing the first and second shutters of the intermediate transfer unit when said unit is installed on the movable side frame.
Figure 25:
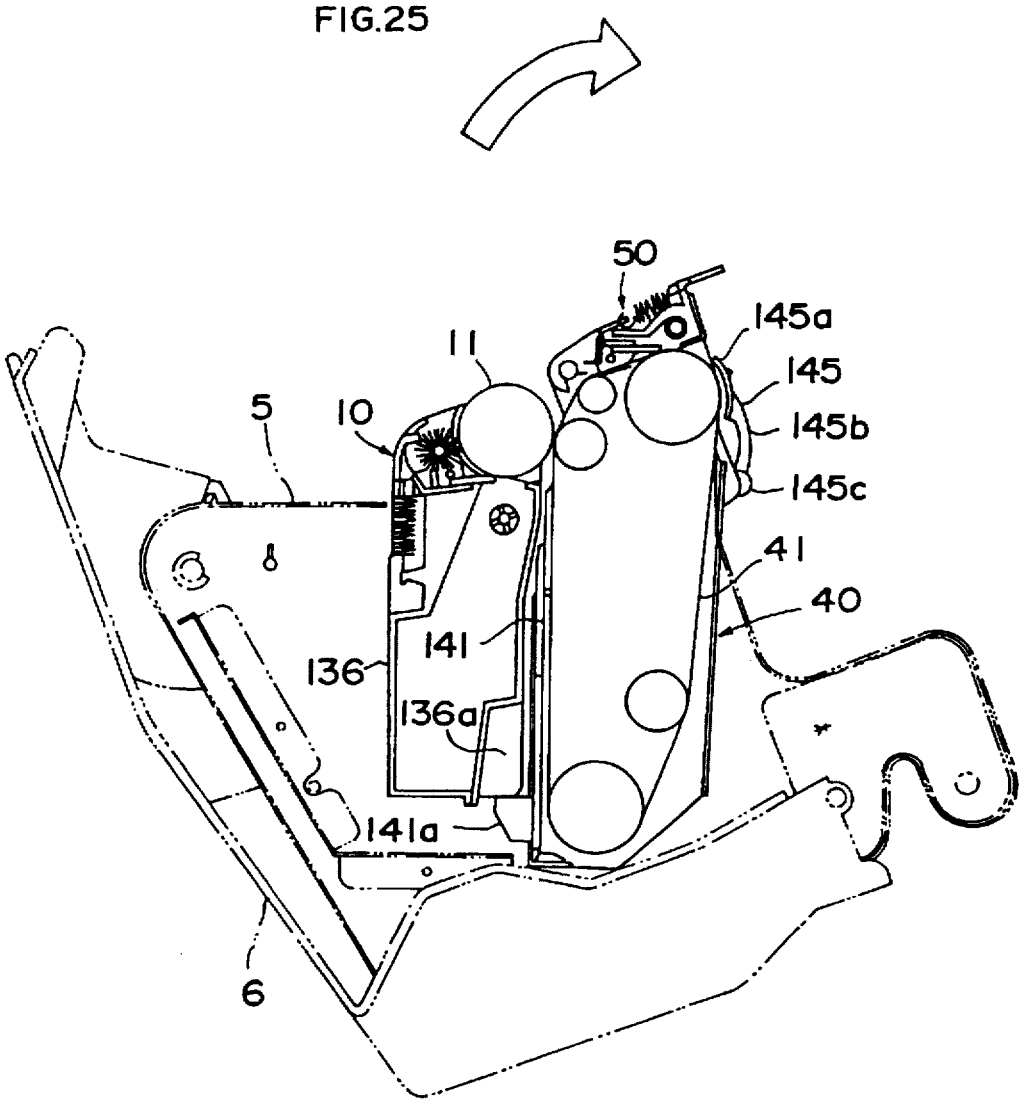
FIG. 25 is a side view of the essential portion showing first and second shutters of the intermediate transfer unit when the photosensitive member unit is integratedly joined to the intermediate transfer unit.
Figures 28A, 28B, 28C, 28D:
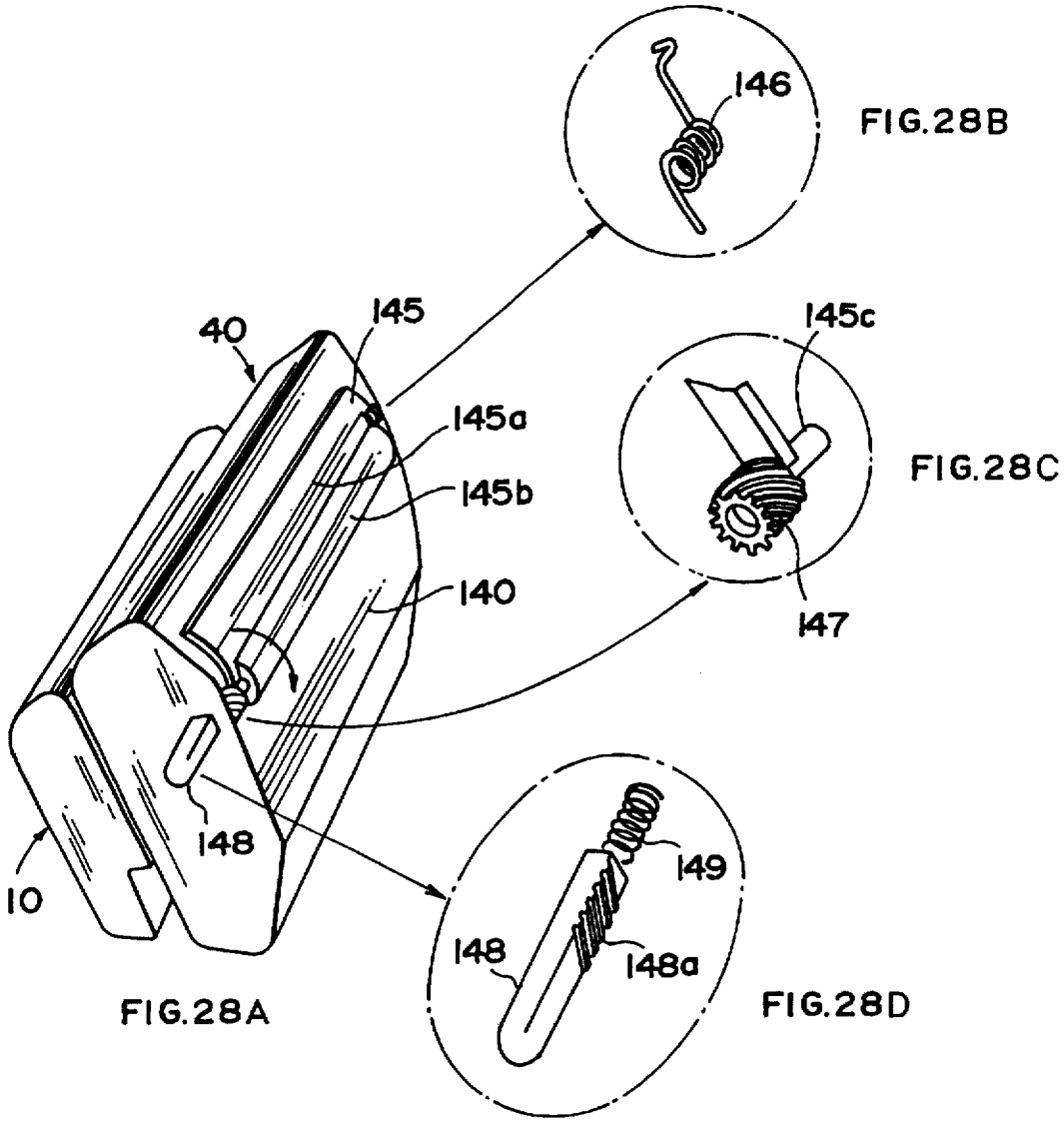
FIGS. 28A, 28B, 28C, and 28D are perspective views illustrating the second shutter and specific components thereof.

Second shutter 145 protects the secondary transfer region of intermediate transfer belt 41, and comprises shutter 145*a* and arm 145*b* as shown in FIGS. 24 and 28A. Arm 145*b* is rotatably mounted on housing 140 via shaft 145*c*, and one end of shaft 145*c* is normally forced in a clockwise direction by the spring force of torsion spring 146 (FIG. 28B) provided on one end of shaft 145*c*. A helical gear 147 is fixedly mounted on the other end of shaft 145*c* (FIG. 28C) and a lever 148 having a rack 148*a* is installed on housing 140 and is normally pushed outward via the force exerted by coil spring 149 (FIG. 28D). The rack 148*a* of lever 148 engages helical gear 147.

When movable frame 5 is opened (refer to FIGS. 24 and 25), and when intermediate transfer unit 40 is removed from movable frame 5 (refer to FIG. 28A), second shutter 145 is rotated in a counterclockwise direction by the spring force exerted by torsion spring 146, such that shutter 145*a* covers the secondary transfer region of intermediate transfer belt 41. At this time, lever 148 extends from housing 140 via the spring force exerted by coil spring 149.

When intermediate transfer unit 40 is removed by itself, there is concern that the primary transfer region and secondary transfer region of intermediate transfer belt 41 may be exposed, but according to the aforesaid construction, said transfer regions are protected by shutters 141 and 145. Furthermore, when integrated with photosensitive unit 10, it is possible for first shutter 141 to open the primary transfer region while intermediate transfer belt 41 is in contact with photosensitive drum 11. When movable frame 5 is closed, it is possible for secondary shutter 145 to open the secondary transfer region while the recording sheet S is in contact with the secondary transfer roller 59 and intermediate transfer belt 41.

Second shutter sheet guide function

When intermediate transfer unit 40 is set at a predetermined position in body 1, second shutter 145 can move perpendicular to the paper supply section 60 as shown in FIG. 26. Accordingly, shutter 145*a* of second shutter 145 guides recording sheet S from feed roller 62 to timing roller 63. Arm 145*b* guides recording sheet S from timing roller 63 to the secondary transfer region.

Thus, special guide members may be omitted by the added guide functions for recording sheet transport performed by second shutter 145.

Other embodiments

The image forming apparatus of the present invention is not limited to the previously described embodiments and may be variously modified insofar as such modifications do not depart from the scope of the invention.

For example, the present invention is applicable not only to apparatus which print out images by print data from an external device, and is also applicable to full color copiers provided with a document image reading means.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

an apparatus housing having a stationary first frame and a releasable and movable second frame which is opened on a front side of the image forming apparatus;

a feed path constructed by a first member and a second member which are both repositioned relative to but generally within the feed path in response to the opening of said second frame;

a driving mechanism; and a fixing device engaging said driving mechanism, where in response to the opening of said second frame said fixing device and said driving mechanism disengage.

2. An image forming apparatus as defined in claim 1, further comprising:

a cover which is opened on a back side of the image forming apparatus, where in response to the opening of said cover, said driving mechanism cuts transmission of a driving force to said fixing device.

3. An image forming apparatus as defined in claim 2, further comprising a linkage mechanism which links the opening of said second frame to the repositioning of said first and second members.

4. An image forming apparatus as defined in claim 2, wherein said fixing device is mounted on said first frame.

5. An image forming apparatus as defined in claim 2, wherein said fixing device includes two rollers, the two rollers maintaining contact with each other when said fixing device and said driving mechanism disengage in response to the opening of said second frame.

6. An image forming apparatus as defined in claim 1, further comprising a linkage mechanism coupled between said second frame and said first member and between said first member and said second frame, which links the opening of said second frame to the repositioning of said first and second members.

7. An image forming apparatus as defined in claim 1, wherein said fixing device is mounted on said first frame.

8. An image forming apparatus as defined in claim 1, wherein said fixing device includes two rollers, the two rollers maintaining contact with each other when said fixing device and said driving mechanism disengage in response to the opening of said second frame.

9. An image forming apparatus, comprising:

an apparatus housing having a stationary first frame and a releasable and movable second frame which is opened for internal access to the image forming apparatus;

a feed path constructed by at least a first member, wherein the first member moveably engages said second frame in both an open state and a closed state;

a driving mechanism in communication with the first member; and a fixing device engaging said driving mechanism, where in response to the opening of said second frame said driving mechanism and said fixing device disengage.

10. An image forming apparatus comprising:

an apparatus housing having a stationary first frame and a releasable and movable second frame which may be opened on a front side of the image forming apparatus;

a feed path constructed by a first member and a second member which are repositioned in response to the opening of said second frame, said feed path extending from the front side to a back side of the image forming apparatus and being mounted on said first frame; and a fixing device having a driving mechanism which cuts transmission of a driving force to said fixing device in response to the opening of said second frame.

11. An image forming apparatus as claimed in claim 10, wherein the first member and second member are repositioned relative to but within the feed path in response to the opening of said second frame.

12. An image forming apparatus as defined in claim 11, further comprising a linkage mechanism which links the opening of said second frame to the repositioning of the first and second members.

13. An image forming apparatus as defined in claim 11, wherein said fixing device is mounted on said first frame.

14. An image forming apparatus as defined in claim 11, wherein said fixing device includes two rollers, the two rollers maintaining contact with each other when transmission of the driving force to said fixing device is cut off in response to the opening of said second frame.

15. An image forming apparatus as defined in claim 10, further comprising a linkage mechanism which links the opening of said second frame to the repositioning of the first and second members.

16. An image forming apparatus as defined in claim 10, wherein said fixing device is mounted on said first frame.

17. An image forming apparatus as defined in claim 10, wherein said fixing device includes two rollers, the two rollers maintaining contact with each other when transmission of the driving force to said fixing device is cut off in response to the opening of said second frame.

18. An image forming apparatus as defined in claim 10, further comprising a cover which may be opened on the back side of the image forming apparatus, wherein the driving mechanism cuts transmission of the driving force to said fixing device in response to the opening of said cover.

19. An image forming apparatus as defined in claim 18, further comprising a linkage mechanism which links the opening of said second frame to the repositioning of the first and second members.

20. An image forming apparatus as defined in claim 18, wherein said fixing device is mounted on said first frame.

21. An image forming apparatus as define din claim 18, wherein said fixing device includes two rollers, the two rollers maintaining contact with each other when transmission of the driving force to said fixing device is cut off in response to the opening of said second frame.

* * * * *